United States Patent [19]

Iino et al.

[11] Patent Number: 4,743,522

[45] Date of Patent: May 10, 1988

[54] PHOTOSENSITIVE MEMBER WITH HYDROGEN-CONTAINING CARBON LAYER

[75] Inventors: Shuji Iino, Hirakata; Hideo Hotomi, Suita; Izumi Osawa, Ikeda; Mitsutoshi Nakamura, Osaka, all of Japan

[73] Assignee: Minolta Camera Kabushiki Kaisha, Osaka, Japan

[21] Appl. No.: 905,528

[22] Filed: Sep. 10, 1986

[30] Foreign Application Priority Data

| | | | |
|---|---|---|---|
| Sep. 13, 1985 | [JP] | Japan | 60-204154 |
| Sep. 19, 1985 | [JP] | Japan | 60-207897 |
| May 17, 1986 | [JP] | Japan | 61-112847 |

[51] Int. Cl.[4] ..... G03G 5/14

[52] U.S. Cl. ..... 430/58; 430/61; 430/65

[58] Field of Search ..... 430/58, 60, 61, 62, 430/63, 64, 65

[56] References Cited

U.S. PATENT DOCUMENTS

| | | | |
|---|---|---|---|
| 3,956,525 | 5/1976 | Yasuba | 427/41 |
| 4,365,013 | 12/1982 | Ishioka et al. | 430/57 |
| 4,376,688 | 3/1983 | Ceasar et al. | 204/192 |
| 4,394,426 | 7/1983 | Shimizu et al. | 430/65 |
| 4,409,308 | 10/1983 | Shimizu et al. | 430/60 |
| 4,416,755 | 11/1983 | Caesar et al. | 204/192 |
| 4,451,546 | 5/1984 | Kawamura et al. | 430/69 |
| 4,452,874 | 6/1984 | Ogawa et al. | 430/57 |
| 4,465,750 | 8/1984 | Ogawa et al. | 430/57 |
| 4,466,380 | 8/1984 | Jansen et al. | 118/712 |
| 4,471,042 | 9/1984 | Komatzu et al. | 430/64 |
| 4,490,450 | 12/1984 | Shimizu et al. | 430/57 |
| 4,491,626 | 1/1985 | Kawamura et al. | 430/69 |
| 4,495,262 | 1/1985 | Matsuzaki et al. | 430/58 |
| 4,510,224 | 4/1985 | Yamazaki et al. | 430/57 |
| 4,513,022 | 4/1985 | Jansen et al. | 427/39 |
| 4,513,073 | 4/1985 | Jeffrey, III et al. | 430/65 |
| 4,518,670 | 5/1985 | Matsuzaki et al. | 430/58 |
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/60 |
| 4,592,982 | 6/1986 | Saitoh et al. | 430/57 |
| 4,598,032 | 7/1986 | Saitoh et al. | 430/58 |
| 4,634,648 | 1/1987 | Jansen et al. | 430/84 |
| 4,686,164 | 8/1987 | Osawa et al. | 430/63 |

FOREIGN PATENT DOCUMENTS

| | | |
|---|---|---|
| 194329 | 7/1982 | European Pat. Off. . |
| 3525908 | 4/1985 | Fed. Rep. of Germany . |
| 5928161 | 4/1979 | Japan . |
| 5938753 | 1/1980 | Japan . |
| 60125846 | 7/1981 | Japan . |
| 60130747 | 11/1981 | Japan . |
| 150753 | 11/1981 | Japan . |
| 115552 | 4/1982 | Japan . |
| 61243460 | 11/1982 | Japan . |
| 154850 | 2/1983 | Japan . |
| 5586169 | 6/1983 | Japan . |
| 171038 | 8/1983 | Japan . |
| 88753 | 10/1983 | Japan . |
| 214859 | 1/1984 | Japan . |
| 136742 | 9/1984 | Japan . |
| 63531 | 3/1985 | Japan . |
| 137977 | 4/1985 | Japan . |
| 63541 | 7/1985 | Japan . |
| 61761 | 11/1985 | Japan . |
| 5660447 | 12/1985 | Japan . |
| 5146130 | 3/1986 | Japan . |

OTHER PUBLICATIONS

"A C-NMR Investigation of Plasma Polymerized Ethane, Ethylene, and Acetylene" by A. Dilks, S. Kaplan, and A. Vanlaeken, Xerox Webster Research Center, Xerox Square, W-114, Rochester, New York 14644. Journal of Applied Polymer Science, vol. 17, pp. 885-892, (1973), Formation of an Amorphous Powder During the Polymerization of Ethylene in a Radio-Frequency Discharge.

*Primary Examiner*—John L. Goodrow

*Attorney, Agent, or Firm*—Burns, Doane, Swecker & Mathis

[57] ABSTRACT

The present invention provides a photosensitive member comprising a carrier transporting layer of hydrogen-containing carbon and an adhesive layer of hydrogen-containing carbon, said adhesive layer comprising at least one element selected from silicon, germanium and aluminum. The photosensitive member of the present invention is excellent in a charge transporting property, an adhesive property of a substrate with a hydrogen-containing layer, a chargeability, a rigidity and resistances to corona, acid, moisture and heat.

7 Claims, 3 Drawing Sheets

M
C
1
2
3
4
5

PHOTOSENSITIVE MEMBER WITH HYDROGEN-CONTAINING CARBON LAYER

BACKGROUND OF THE INVENTION

The present invention relates to a photosensitive member, particularly to a photosensitive member comprising a hydrogen-containing carbon layer as a charge transporting layer.

Electrophotography has been remarkably developed since the invention of the image-transfer type. Various new materials have also been developed and have been practised.

The main materials for conventional electrophotosensitive members include inorganic compounds such as non-crystalline selenium, selenium-arsenic, selenium-tellurium, zinc oxide, amorphous silicon and the like, and organic compounds such as polyvinylcarbazole, metal phthalocyanine, dis-azo pigments, tris-azo pigments, perillene pigments, triphenylmethanes, triphenylamines, hydrazones, styryl compounds, pyrazolines, oxazoles, oxadiazoles and the like.

Structures of electrophotosensitive members include a single layer type using one of the above compounds, a binder type in which the above compounds are dispersed in a binder resin, and a multilayer type containing carrier generating layers and carrier transporting layers.

All conventional materials for electrophotosensitive members, however, respectively have defects, one of which is poisonous for humans. Additionally, in order to use these electrophotosensitive members in a copying machine, initial properties must be kept constant, when they are exposed to serious conditions at charge, exposure, development, transference, erasing, cleaning and the like. Many organic compound are poor in durability, and have many unstable properties.

Recently, in order to improve the above problems amorphous silicon (referred to as a-Si hereinafter) formed by a plasma chemical vapor deposition (referred to as plasma CVD) has been applied to produce a photosensitive member.

A-Si photosensitive members have several excellent properties. But the relative dielectric constant ($\epsilon$) of a-Si is so large (about 12) that it essentially needs a thickness of at least 25 $\mu$m to gain a sufficient surface potential for a photosensitive member. In addition, in the production of an a-Si photosensitive member by plasma CVD a long production time is needed because of the slow deposition rate of an a-Si layer. The long deposition time makes it difficult to obtain a homogeneous a-Si layer with the result that image defects such as white spot noises are liable to occur at a high percentage. Further, the cost becomes expensive.

Though many attempts to improve the above defects have been made, it is not prefered to make the layers thinner.

On the other hand, an a-Si photosensitive member has additional defects such as weak adhesive strength between a-Si layer and electroconductive substrate, and poor resistances to corona, external circumstances and chemicals.

It has been proposed to use an organic polymeric layer which is produced by plasma polymerization (referred to as OPP layer hereinafter) and is arranged as an overcoat layer or an undercoat layer in order to solve the above problems. The former is proposed, for instance, in U.S. Pat. No. 3,956,525, and the latter is done in Japanese Patent KOKAI No. 63541/1985.

It is known that an OPP layer can be produced from various kinds of organic compound such as ethylene gas, benzenes, aromatic silanes and the like (e.g. Journal of Applied Polymer Science Vol. 17, 885–892 (1973), by A. T. Bell et al.). However, the OPP layer produced by these conventional methods is restrictively used as an insulator. Therefore, the layer is considered as an insulating layer having an electrical resistance of about $10^{16}$ $\Omega$.cm when an ordinary polyethylene layer or at least similar to such a layer.

Recently, there is proposed a layer comprising diamond-like carbon in the semiconductor field. But charge transportability thereof has not been suggested at all.

U.S. Pat. No. 3,956,525 discloses a photosensitive member consisting of a substrate, a sensitizing layer, an organic photoconductive electrical insulator and a glow discharging polymer layer having a thickness of 0.1–1 $\mu$m in the above order. This polymer layer is provided to cover the surface so as to stand up to wet development as an overcoat. Carrier transportability of the layer is not suggested.

Japanese Patent KOKAI No. 63541/1980 discloses a photosensitive member comprising an undercoat layer composed of a diamond-like carbon and having a thickness of 200 Å to 2 $\mu$m and an a-Si photoconductive layer formed on said undercoat layer. This undercoat layer is formed to improve adhesion of the a-Si layer to the substrate. The undercoat layer may be so thin that a charge moves through it by tunnel effect.

As mentioned above, photosensitive members have been proposed which comprises an undercoat layer or an overcoat layer composed of an electrically insulating OPP layer, a diamond-like layer and the like, but the transport of the charge is basically attributed to the tunnel effect and the phenomena of dielectric breakdown.

The tunnel effect is caused due to the passage of electron, when the thickness of an insulating layer is very thin (generally at an Angstrom unit).

The dielectric breakdown phenomenon is where the small quantity of existing charge carriers are accelerated by an electric field to gain sufficient energy to be capable of ionizing atoms in the insulator, with the result that carriers increase by the ionization. This phenomena occurs at a high electric field (generally more than 100 V/$\mu$m).

In the case of a photosensitive member having laminated layers of an insulating layer and a semiconducting layer, charges generated in the semiconducting layer move through the layer under an electric field, but they can not pass through the insulating layer under a low electrical field. If the insulating layer is thin, it is ignored as a surface potential or it does not adversely affect properties of photosensitivity because of negligible development influence. Further, even if charges are accumulated on the insulating layer by repeated use to give a higher potential, the potential in the electric field does not increase above a constant level (e.g. 100 V/$\mu$m) because of the dielectric breakdown.

For example, when an insulating layer comprising insulating materials capable of causing dielectric breakdown at 100 V/$\mu$m is formed at a thickness of 0.1 $\mu$m, the increase of the residual potential based on the repetition is only 10 V.

According to the above reasons, it has been understood that if a conventional insulating layer is used in a photosensitive member, the thickness of the layer has to be less than about 5 μm, or else the residual potential based on the insulating layer increases to more than 500 V causing an overlap of the copied image to occur.

SUMMARY OF THE INVENTION

The primary object of the present invention is to provide a photosensitive member which is free of the above-mentioned drawbacks, has excellent charge transportability and chargeability, and is capable of obtaining a good copy image.

The second object of the present invention is to provide a photosensitive member with excellent adhesion of an charge transporting layer or a charge generating layer with a substrate and prevention of interferrence fringes and blurredness.

Another object of the invention is to provide a photosensitive member capable of being produced at lower cost and within short time.

Still another object of the invention is to provide a photosensitive member comprising a charge transporting layer which has excellent corona resistance, acid resistance, humid resistance, heat resistance and rigidity.

These and other objects of the invention can be accomplished by providing a photosensitive member which comprises an electrically conductive substrate;

an adhesive layer on said substrate comprising hydrogen-containing carbon and at least one element selected from silicon, germanium or aluminium; said adhesive layer having a thickness of about 0.01 μm to 0.5 μm;

a charge transporting layer comprising a hydrogen-containing carbon; said hydrogen being in an amount of 0.1 to 67 atomic percent based on the amount of all atoms contained in said charge transporting layer; and a charge generating layer.

DETAILED DESCRIPTION OF THE INVENTION

Figures 1, 2, 3, 4, 5, 6, 7, 8, 9, 10, 11, 12, 13:
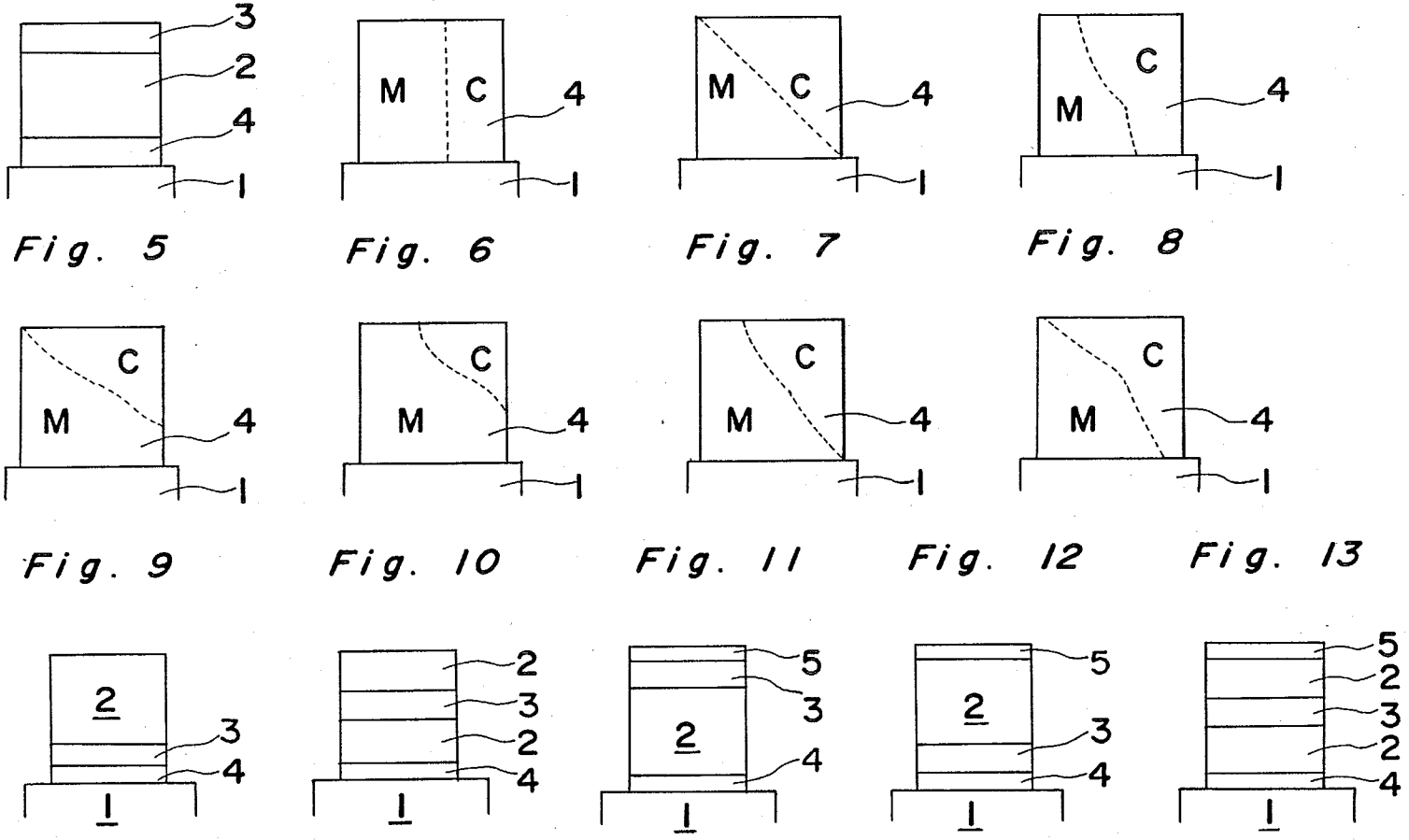
FIG. 1 is a schematic sectional view of photosensitive members of the present invention.
FIGS. 2–8 are distribution of the elements and carbon in an adhesive layer.
FIGS. 9–13 are schematic sectional views of photosensitive members of the present invention.

FIG. 1 shows an embodiment of a photosensitive member of the invention to illustrate the construction thereof. The photosensitive member comprises an electrically conductive substrate (1), a hydrogen-containing carbon layer (2) (referred to as the C:H layer hereinafter) which functions as a charge transporting layer; a charge generating layer (3), and an adhesive layer (4). Said adhesive layer on said substrate includes hydrogen-containing carbon and at least one element selected from silicon, germanium or aluminium, and said adhesive layer has a thickness of about 0.01 μm to 0.5 μm; said charge transporting layer includes a hydrogen-containing carbon, and said hydrogen is in an amount of 0.1 to 67 atomic percent based on the amount of all atoms contained in said charge transporting layer.

An electrophotosensitive member requires a dark resistance of not less than $10^9$ Ω.cm and a ratio of light-/dark resistance (i.e. gain) of at least $10^2$ to $10^4$, even in a functionally separating photosensitive member.

The photosensitive member of the present invention is constituted by the carrier generating layer (3) and the C:H layer (2), which functions as a carrier transporting layer contains at least one C:H charge transporting layer.

The C:H charge transporting layer (2) contains hydrogen at 0.1 to 67 atomic percent based on the amount of all atoms contained in said C:H layer, preferably 1 to 60 atomic percent, more preferably 30 to 60 atomic percent, and most preferably 40 to 58 atomic percent. The C:H charge transporting layer having less than 0.1 atomic percent gives a dark resistance unsuitable for electrophotography, and more than 67 atomic percent will not give carrier transportability.

The C:H carbon charge transporting layer of the present invention can be produced as an amorphous carbon or a diamond-like carbon according to the hydrogen content or the process for production. For the most part, an amorphous C:H charge transporting layer is obtained, which is soft and of high resistance to electricity. However, when the layer having a hydrogen content of less than about 40 atomic percent is produced by the plasma CVD method, a diamond-like carbon layer can be obtained. Such a layer is harder having a Vickers hardness of more than 2000 and has the resistance of more than $10^8$ Ω.cm.

Further, the C:H layer of the present invention can be produced as a polymer layer, for example, a polymer layer formed by a plasma polymerization.

Polymer layers formed by plasma polymerization show excellent charge transportability when combined with charge generating layers.

Hydrogen content of the C:H charge transporting layer and the structure thereof can be determined by elemental analysis, IR analysis, $^1$H-NMR, $^{13}$C-NMR and the like.

A C:H charge transporting layer of the present invention preferably has an optical energy gap (Egopt) of 1.5 to 3.0 eV, and a relative dielectric constant (ε) of 2.0 to 6.0.

A C:H charge transporting layer having a smaller Egopt (less than 1.5 eV) forms many levels near the end of the bands, that is, at the lower end of the conduction band and the upper end of the filled band. Therefore, in this case the C:H charge transporting layer is not always suitable as a charge transporting layer because of its smaller mobility of carriers and shorter carrier life. A C:H charge transporting layer having a larger Egopt (more than 3.0 eV) has a tendency to make a barrier at the interface between the charge generating materials and the charge transporting materials which are ordinarily used for an electrophotosensitive member, so there are cases when the injection of carriers from the charge generating layer to the C:H layer and from the C:H layer to the charge generating layer cannot be achieved. As a result, excellent photosensitive properties cannot be obtained.

In the meanwhile, where the relative dielectric constant (ε) is larger than 6.0, charging capacity and sensitivity decrease. Increasing the thickness of the C:H layer has been considered in order to overcome these drawbacks, but the increase in thickness of the C:H charge transporting layer is not desirable for production purposes. If the relative dielectric constant is less than 2.0, the properties of the charge transporting layer become similar to those of polyethylene so as to reduce the charge transportability.

The hydrogen contained in the C:H charge transporting layer (2), as a charge transporting layer, may be partially substituted with halogen, for instance, fluorine, chlorine, bromine and the like. Such charge transporting layers have improved water repellancy and abrasion resistance due to the substitution.

The thickness of the C:H charge transporting layer (2) as a charge transporting layer is preferably about 5–50 μm, more preferably 7–20 μm. The C:H charge transporting layer having a thickness of less than 5 μm has low charging capacity, with the result that a sufficient contrast can not be obtained on a copied image. A thickness of more than 50 μm is not desirable for production. The C:H charge transporting layer has an excellent light transparency, a high dark resistance and a high charge transportability. Even if the thickness of the layer exceeds 5 μm, carriers can be transported without trapping.

The C:H charge transporting layer (2) of the present invention may be produced under ionized conditions by ion vapor deposition, ion beam deposition and the like; under plasma conditions by direct current, high frequency, microwave plasma methods and the like; and through a neutral particle by reduced compression CVD, vacuum vapor deposition, sputtering methods optical CVD are like and the combination thereof. However, for instance, in the case that charge generating layers are produced by a high frequency plasma or CVD, it is desirable to produce C:H charge transporting layers by the same method to reduce apparatus costs and obtain labor saving.

Carbon sources for the C:H charge transporting layer may include $C_2H_2$, $C_2H_4$, $C_2H_6$, $C_3C_6$, $CH_4$, $C_4H_{10}$, $C_4H_6$, $C_4H_8$, $C_3H_8$, $CH_3CHO$, $C_8H_8$, $C_{10}H_{16}$, and the like.

The carrier gas may preferably include $H_2$, Ar, Ne, He and the like.

In order to obtain a hydrogen-containing carbon layer having a hydrogen content of not more than 40 atomic percent in a plasma polymerization, a saturated hydrocarbon, diluted with hydrogen is preferably used. Examples of the most preferable saturated hydrocarbones are methane, ethane, propane or butane. The plasma polymerization is carried out under low pressure and high voltage. Production of such a hydrogen-containing carbon layer having a low hydrogen content may be produced by an ion beam method as well as by plasma polymerization. Such a method is described in J. Appl. Phys. 52, (10) October 1981 (6151–6157). Of course, a sputtering method may be used.

As a C:H charge transporting layer having a low hydrogen content has excellent rubbing resistance and moisture resistance, a charge transporting layer comprising such a C:H layer may be arranged on the surface side. If arranged on the substrate side, it prevents charge from injecting to the substrate, and presents plasma damage when a charge generating layer is formed thereon by high frequency plasma.

The C:H charge transporting layer may contain hydrogen at a content of more than 40 atomic percent. Such a C:H charge transporting layer having a high hydrogen content may be produced by a plasma discharge or an ion beam using unsaturated hydrocarbons such as ethylene, propylene, acetylene and the like diluted with hydrogen. The pressure of the reactor for the plasma discharge is preferably higher than that for the production of a C:H layer having a low hydrogen content and the voltage is preferably lower than that of the C:H charge transporting layer having a low hydrogen content.

If a C:H charge transporting layer having a high hydrogen content is used as a charge transporting layer and is to be combined with an a-Si charge generating layer, a photosensitive member can be obtained, which has superior charging capacity and sensitivity to a photosensitive member produced from a-Si alone. Further, a C:H charge transporting layer arranged on the substrate side acts as a charge injection preventing layer. Such a layer also improves rigidity of the surface, rubbing resistance, moisture resistance, corona resistance and adhesion.

A C:H charge transporting layer having a comparably higher hydrogen content (i.e. more than 55 atomic percent) is referred to as the plasma polymerization layer (referred to as a APP C:H layer hereinafter). PP C:H layer has a highly cross-linked net structure different from the aforementioned C:H layer. Therefore, the PP C:H layer has high density, high rigidity, high chemical resistance and heat resistance. Further, this PP C:H layer traps free radicals so as to have a higher dielectric loss than the aforementioned C:H layer. A polyermized polyethylene layer by plasma deposition is a typical plasma polymerization layer with ratio of a hydrogen atoms to carbon atoms of about 2.7/2, but does not have a melting point corresponding to the melting point of ordinary polyethylene, but has a heat resistance of more than 330° C.

According to the present invention an element belonging to group IIIA or VA group of the Periodic Table may be incorporated into C:H charge transporting layer (2) in order to control the charging properties of charge transporting layers.

Reverse bias effect may be achieved by making the substrate side P-type and the surface side N-type when the photosensitive member is positively charged, and by making the substrate side N-type and the surface side P-type when it is negative charged. In the above manner various effects such as improvement of the charging capacity, decrease of the reduction rate of the surface potential in darkness and improvement of the sensitivity of a photosensitive member, can be obtained.

In a photosensitive member formed by laminating C:H charge transporting layers and charge generating layers, elements of group VA or IIIA may be incorporated into a charge transporting layer or, if desired, into the charge generating layer such that when positively charged the surface side becomes comparatively N-type and the substrate side becomes comparatively P-type whenever the carrier generating layer is arranged on the surface side and the charge transporting layer is on the substrate side or vice versa.

Polarity may be controlled by gradually increasing an element of group IIIA or VA on the surface side or the substrate side within a layer, or a single charge transporting C:H layer containing an element of group IIIA or VA may be arranged on the surface side or the substrate side. Alternatively, if necessary, plural C:H charge transporting layers with different concentration of an element of group IIIA or VA may be arranged at conjunction areas so as to form depletion layers.

A photosensitive member of the invention has an adhesive layer between a substrate and for instance a charge transporting layer. FIG. 1 is a schematic view of a photosensitive member, in which (1) is a substrate, (2) is a charge transporting layer, (3) is a charge generating layer and (4) is an adhesive layer.

The adhesive layer comprises hydrogen containing carbon (C:H) and an element such as silicon, germanium and/or aluminium. Silicon and/or germanium is most preferable. The amount of the element is represented as atomic % (referred to as atm.% hereinafter) calculated from the formula, M/(C+M) in which M is Si, Ge and/or Al and C is carbon. An amount of elements is 5–95 atm.%, especially 20–80 atm.% when the elements are incorporated uniformly along the laminating direction. An adhesive layer is preferably about 0.01–5 μm in thickness, the charge transporting layer is preferably about 5–50 μm in thickness.

An element may be uniformly incorporated into the adhesive layer (4) as shown in FIG. 2 or nonuniformly as shown in FIGS. 3–8 along the laminating direction. Carbon is preferably included such that its amount increases toward the side of a transporting layer. A concentration gradient is advantageous for adhesion and prevention of the reflection of light.

In FIGS. 2–8, (M) represents Si, Ge and/or Al, and (C) represents carbon. FIG. 3 shows that a lesser amount of (C) and a greater amount of (M) are incorporated at the side of the substrate (1) and then (C) increases and (M) decreases along the laminating direction so that the (C) content is 100 atm.% at the contact surface of the C:H charge transporting layer with the adhesive layer.

In order to incorporate elements such as Si, Ge and/or Al into an adhesive layer, suitable gasous compounds containing these elements are deposited with hydrogen gas under an ionized state or a plasma state. This invention is not restricted by the above methods. Suitable metal compounds of Si, Ge and/or Al include:

Si: $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$

Ge: $GeH_4$, $GeCl_4$, $Ge(OC_2H_5)_4$, $Ge(C_2H_4)_4$,

Al: $Al(Oi\text{-}C_3H_7)_3$, $(CH_3)_3Al$, $(C_2H_5)_3Al$, $(i\text{-}C_4H_8)_3Al$, $AlCl_3$ A C:H adhesive layer containing Si has a high dark resistance and the effect of preventing charge injection from a substrate. A C:H adhesive layer containing Ge is effective for the prevention of light reflection. Hydrogen-containing carbon (C:H) comprised therein is the same as the C:H charge transporting layer and is formed in a similar way, as mentioned hereinbefore.

The C:H adhesive layer contains hydrogen 0.1–67 atom.% based on the all atoms therein, preferably 1–50 atm.%, A C:H adhesive layer having hydrogen more than 67 atm.% becomes too flexible to have good adhesive properties.

The hydrogen in the C:H adhesive layer may be partially substituted with halogen, particularly Cl, F, Br.

A C:H adhesive layer containing halogen has a small refraction index and is effective for the prevention light reflection.

Halogens are incorporated into the C:H adhesive layer by depositing suitable gaseous compounds containing halogen with hydrocarbon gas under a plasma state etc. Halogen-containing compounds include: $Fe_2$, HCl, HBr, HF, $C_2H_5Cl$, $C_2H_3Cl$, $CH_3Br$, $COCl_2$, $CHClF_2$, $CCl_3F$, $CCl_2F_2$, $CClF_3$, $CF_4$, $CHF_3$, $C_2F_6$, $C_3F_8$, $CBrF_3$, $CCl_4$, $CHCl_3$, $CH_2Cl_2$, $CH_3Cl$, $NF_3$.

Additional elements such as S, B, P, As may be incorporated into a C:H adhesive layer. A C:H adhesive layer containing S is a black layer and prevents reflection of surplus light on the substrate and the interference of light. B, P, and As are effective for adjustment of polarity.

The photosensitive member of FIG. 1 may have a protective surface layer on the charge generating layer.

With reference to FIG. 1, if the photosensitive member is positively charged and then exposed to the light image, charge carriers are generated in the charge generating layer (3). The electrons neutralize the surface charge. The holes are transported to the substrate (1) by the excellent charge of transportability of the C:H charge transporting layer (2). When an a-Si charge generating layer without any polarity control, is used with a positive charge, the C:H charge transporting layer is preferably controlled be a relative P-type. Since a-Si itself is of weak N-type or intrinsic, it has a tendency to control the injection of positive charge from the surface, and a C:H charge transporting layer controlled to be a P-type facilitates the movement of holes.

Elements of group IIIA used to form a P-type layer may include B, Al, Ga, In and the like, especially B. The surface layer may be controlled to be a relatively higher N-type by incorporating elements of the VA group, such as P, into the a-Si charge generating layer. In this case the C:H charge transporting layer may be controlled to be a P-type. When the photosensitive member used has a negative charge, the C:H charge transporting layer (2) is controlled to be an N-type by incorporating P therein. When a-Si is used as the carrier generating layer, B may be incorporated therein.

A C:H adhesive layer (4) is effective for prevention of reflection of surplus light and interference fringes and blurredness.

FIG. 9 illustrates a photosensitive member containing a C:H charge transporting layer (2) as the outermost layer. When this member has a positive charge, the polarity of the C:H charge transporting layer (2) may be controlled to be an N-type in comparison with the charge generating layer (3) by an element of the VA group so as to facilitate mobility of electrons. When it is used at a negative polarity, the C:H charge transporting layer may be inversely controlled by incorporating B, for example.

The photosensitive member of FIG. 10 is an embodiment containing a C:H charge transporting layer (2) on the upper and lower sides of the charge generating layer (3). When it is used at a positive polarity, it is desirable to control the upper C:H charge transporting layer (2) to be an N-type in comparison with the charge generating layer (3) so as to facilitate mobility of electrons, whereas the lower C:H charge transporting layer (2) is controlled to be a P-type.

The photosensitive members illustrated in FIGS. 11–13 have an overcoat layer (5) on the photosensitive members of FIG. 1, FIG. 2 and FIG. 10. The overcoat layers act as a surface protective layer for the charge generating layer (3) or the C:H charge transporting layer (2), and improves the initial surface potential. The thickness of the overcoat layer is preferably about 0.01–5 μm. As a surface protective layer, any materials which are usually used therefor may be used. In the present invention the protective layer may preferably be formed by organic plasma polymerization for production purposes. The overcoat layer may be the C:H layer of the present invention. Elements of groups IIIA or VA may be doped into the surfaces protective layer (5), if necessary.

In order to incorporate elements of group IIIA into the C:H charge transporting layer, suitable gaseous compounds containing these elements are deposited with hydrocarbon gas under an ionized state or a plasma state. Alternatively, the C:H charge transporting layer may be exposed to a gas containing elements of group IIIA to be doped.

Compounds containing boron may include $B(OC_2H_5)_3$, $B_2H_6$, $BCl_3$, $BBr_3$, $BF_3$ and the like.

Compounds containing aluminum may include $Al(Oi\text{-}C_3H_7)_3$, $(CH_3)_3Al$, $(C_2H_5)_3AL$, $(i\text{-}C_4H_8)_3Al$, $AlCl_3$ and the like.

Compounds containing gallium may include $Ga(Oi\text{-}C_3H_7)_3$, $(CH_3)_3Ga$, $(C_2H_5)_3Ga$, $GaCl_3$, $GaBr_3$ and the like.

Compounds containing indium may include $In(Oi\text{-}C_3H_7)_3$, $(C_2H_5)_3In$ and the like.

The content of the elements of group IIIA is preferably not more than 20000 ppm, more preferably about 3–1000 ppm.

Elements of group VA used for polarity control may be P, As, and Sb, especially P. The elements of group VA may be incorporated into the C:H charge transporting layer in the same manner as the group IIIA.

Compounds containing elements of group VA, useable in the present invention, may include $PO(OCH_3)_3$, $(C_2H_5)_3P$, $PH_3$, $POCl_3$ and the like as a compound containing P; $AsH_3$, $AsCl_3$, $AsBr_3$ and the like as a compound containing As; $Sb(OC_2H_5)_3$, $SbCl_3$, $SbH_3$ and the like as a compound containing Sb.

The content of the elements of group VA is preferably not more than 20000 ppm, more preferably about 1–1000 ppm.

The properties of the charge generating layer of the photosensitive members may be controlled by incorporating additional elements.

There are cases when the charge transporting layers are colored to, for instance, yellow, blue, brown or so according to a production condition thereof or by contamination with impurities. In the embodiments of FIGS. 9, 10, 11 and 12 such a phenomena may be utilized to prevent injurious light from transmitting to the charge generating layers.

Phase boundary barriers between the charge generating layers and charge transporting layers may be made smaller by incorporating Si or Ge into the latter to control the band gap.

Nitrogen, oxygen, sulfur and/or various kinds of metals may be additionally incorporated into the C:H charge transporting layers, or a part of hydrogen of the C:H layer may be substituted with halogen.

As a nitrogen source $N_2$, $NH_3$, $N_2O$, NO, $NO_2$ $C_2H_5NH_2$, HCN, $(CH_3)_3N$, $CH_3NH_2$ and the like may be used in general, and addition thereof can make the phase boundary barrier smaller between charge generating layers and charge transporting layers.

As an oxygen source $O_2$, $O_3$, $N_2O$, NO, CO, $CO_2$, $CH_3OCH_3$, $CH_3CHO$ and the like are exemplified. The incorporation of these compounds improves charging capacity, and can accelerate the plasma CVD layer formation rate.

As a sulfur source $CS_2$, $(C_2H_5)_2S$, $H_2S$, $SF_6$, $SO_2$ and the like are exemplified. The incorporation of sulfur is effective for the prevention of light absorption and light interference. In addition, the rate of the layer formation can be made faster by sulfur doping.

Examples of metals capable of incorporating into C:H charge transporting layers are:

Al: $Al(Oi\text{-}C_3H_7)_3$, $(CH_3)_3Al$, $(C_2H_5)_3Al$, $(i\text{-}C_4H_8)_3Al$, $AlCl_3$
Ba: $Ba(OC_2H_5)_3$
Ca: $Ca(OC_2H_5)_3$
Fe: $Fe(Oi\text{-}C_3H_7)_3$, $(C_2H_5)_2Fe$, $Fe(CO)_5$
Ga: $Ga(Oi\text{-}C_3H_7)_3$, $(CH_3)_3Ga$, $(C_2H_5)_3Ga$, $GaCl_3$, $GaBr_3$
Ge: $GeH_4$, $GeCl_4$, $Ge(OC_2H_5)_4$, $Ge(C_2H_4)_4$
Hf: $Hf(Oi\text{-}C_3H_7)_4$
In: $In(Oi\text{-}C_3H_7)_3$, $(C_2H_5)_3In$
K: $KOi\text{-}C_3H_7$
Li: $LiOi\text{-}C_3H_7$
La: $La(Oi\text{-}C_3H_7)_4$
Mg: $Mg(OC_2H_5)_2$, $(C_2H_5)_2Mg$
Na: $NaOi\text{-}C_3H_7$
Nb: $Nb(OC_2H_5)_5$
Sb: $Sb(OC_2H_5)_3$, $SbCl_3$, $SbH_3$
Sr: $Sr(OCH_3)_2$
Ti: $Ti(Oi\text{-}C_3H_7)_4$, $Ti(OC_4H_9)_4$, $TiCl_4$
Si: $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$
Te: $H_2Te$
Se: $H_2Se$
Ta: $Ta(OC_2H_5)_5$
V: $VO(OC_2H_5)_3$, $VO(OtC_4H_9)_3$
Y: $Y(Oi\text{-}C_3H_7)_3$
Zn: $Zn(OC_2H_5)_2$, $(CH_3)_2Zn$, $(C_2H_5)_2Zn$
Zr: $Zr(Oi\text{-}C_3H_7)_4$
Sn: $(CH_3)_4Sn$, $(C_2H_5)_4Sn$, $SnCl_4$
Cd: $(CH_3)_2Cd$
Co: $Co_2(CO)_5$
Cr: $Cr(CO)_6$
Mn: $Mn_2(CO)_{10}$
Mo: $Mo(CO)_6$, $MoF_6$, $MoCl_6$
W: $Wo(CO)_6$, $WCl_6$, $WF_6$ By introduction of a small amount of Si or Ge (less than 5 atm.%) hard layer having a rubbing resistance and water repellance can be produced. Further, the incorporation of the both facilitates the injection of charge from charge generating layer to give a desirable effects such as a decrease of residual potential and an increase of sensitivity.

By the substitution of hydrogen in the C:H charge transporting layer with halogen water repellance, rubbing resistance and light transmittance can be improved. Especially when substitution is of fluorine —CF, —$CF_2$, —$CF_3$, and the like the refractive index (n) becomes smaller (eg. 1.39) so that reflection also becomes smaller.

If the C:H charge transporting layer obtained according to the present invention is contacted with the atmosphere after argon treatment carbonyl groups are formed on the surface of the layer to be activated. The group of —$CF_2$ is changed to —CF.

As a source of carbon and halogen $C_2H_5Cl$, $C_2H_3Cl$, $CH_3Cl$, $CH_3Br$, $COCl_2$, $CCl_2F_2$, $CHClF_2$, $CF_4$, HCl, $Cl_2$, $F_2$ and the like may be used. There are exemplified $GeH_4$ as a source of germanium; $SiH_4$ as a source of silicon; $H_2Te$ as a tellurium; $H_2Se$ as a source of selenium; $AsH_3$ as a source of arsenic; $SbH_3$ as a source of antimony; $BCl_3$ and $B_2H_6$ as a source of boron; and $PH_3$ as a source of phosphorus.

Charge generating layers which may be used in the present invention are not restrictive. Any charge generating layers may be used. Examples of these layers may be a-Si layers which may contain various kinds of elements to change the properties of the layers such as C, O, S, N, P, B, Ge, halogen and the like, and may be of multilayer structures; Se layers; Se-As layers; Se-Te layers; CdS layers; layers made by binding inorganic or organic charge generating compounds with resinous materials; and the like. Such inorganic compounds may include zinc oxide and the like, and such organic compounds may include bis-azo compounds, triarylmethane dye, thiazine dye, oxazine dye, xanthene dye, cyanine dye, styryl dye, pyryliums, azo compounds, quinacridones, indigos, perillenes polycyclic quinones, bis-bezimidazoles, Indanthrenes, squaliliums, phthalocyanines and the like.

Other compounds, so far as these can absorb light to generate carriers at a high efficiency, can be used. Charge generating layers may be formed by any method.

The charge generating layers of the present invention may be arranged anywhere as described before, such as an outermost layer, an innermost layer or a middle layer. The thickness of charge generating layers may be designed such that 90% of 555 nm light can generally be absorbed, which is depended on the kind of materials, especially spectrophotoabsorption properties, sources of light exposure, objects and the like. In the case of a-Si:H, the thickness of the layer is generally about 0.1–1 μm.

The photosensitive member of the present invention contains carrier generating layers and carrier transporting layers and adhesive layers. Therefore, there are at least three processes needed to produce the member. When a-Si layers are formed using, for example, an apparatus for glow discharge decomposition, plasma polymerization can be carried out in the same apparatus. Therefore, C:H charge transporting layers, surface protective layers, adhesive layers and the like are preferably produced by plasma polymerization.

Figure 14:
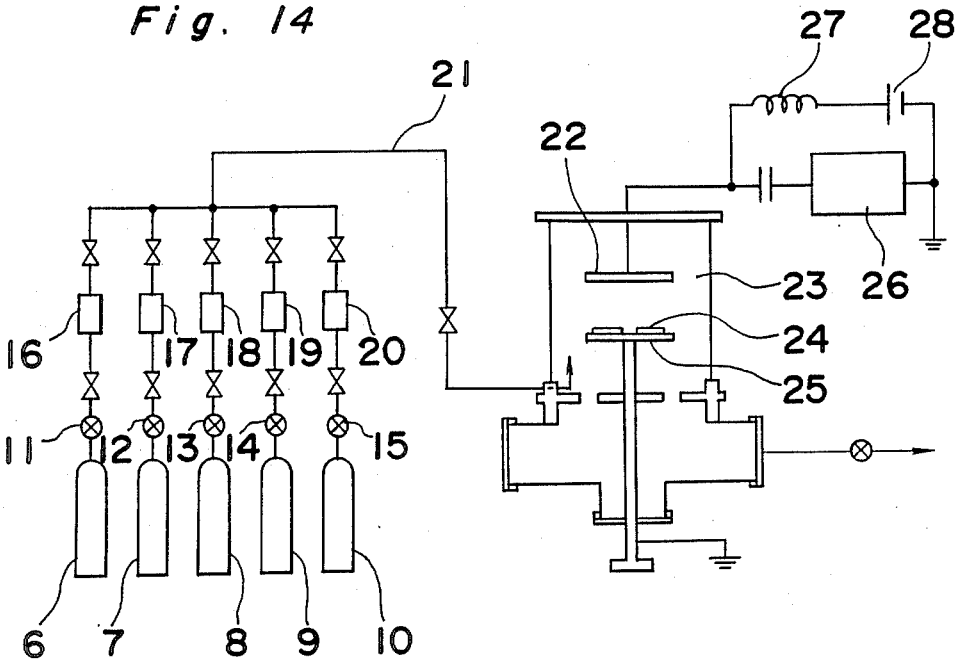
FIGS. 14–16 are examples of apparatus for production of photosensitive members of the present invention.
Figure 15:
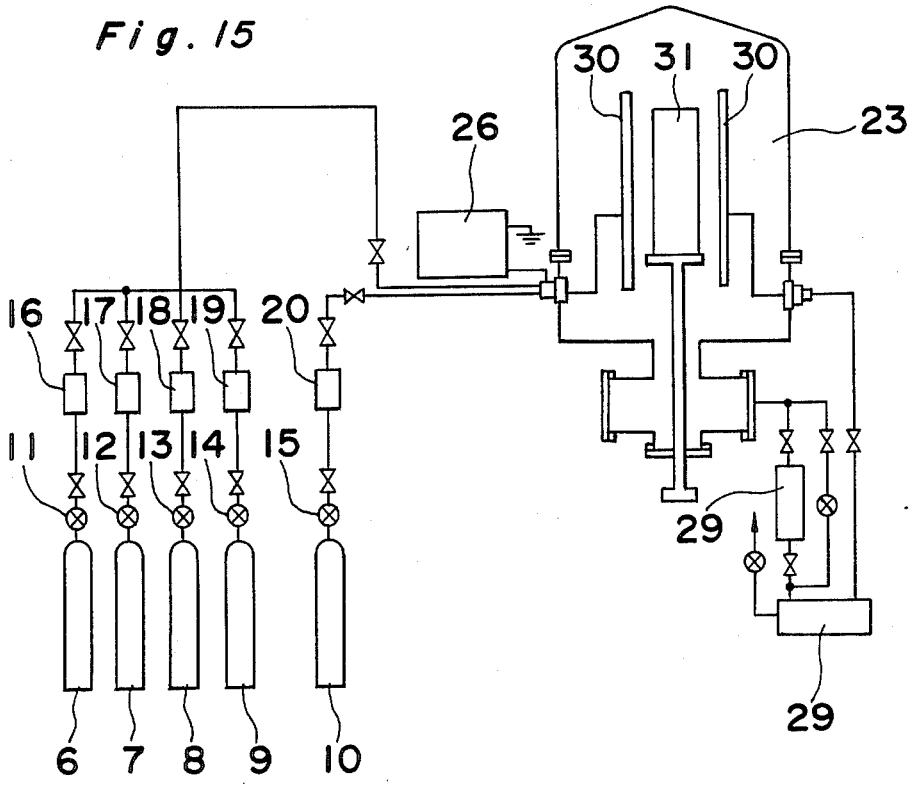

FIGS. 14 and 15 illustrate a capacitive coupling type plasma CVD apparatus for the production of the photosensitive member of the present invention. FIG. 14 shows a parallel plate type plasma CVD apparatus, and FIG. 15 shows a tubular plasma CVD apparatus. Both apparatuses are different in that electrodes (22) and (25) and the substrate (24) of FIG. 14 are plates, but in FIG. 15 the electrode (30) and the substrate (31) are tubular. In the present invention, of course, a photosensitive member can be produced by an induction coupling type plasma CVD apparatus.

Production of the photosensitive member of the present invention is illustrated according to the parallel plate type plasma CVD apparatus (FIG. 14). In FIG. 14, (6)–(10) show the 1st to 5th tanks for $C_2H_4$, $H_2$, $B_2H_6$, $SiH_4$ and $N_2O$ gases respectively, each of which is connected to the 1st to 5th control valves (11)–(15) and the 1st to 5th mass flow controllers (16) to (20) respectively. These gases are sent to a reactor (23) through a main pipe (21).

In the reactor (23) a grounded electrode plate (25), on which the electroconductive substrate such as an Al plate (24) is arranged, is electrically connected with the plate-like electrode (22), which is connected with a high frequency current source (26), facing each other through the condenser. The electrode (22) is connected with a direct current source (28) through a coil (27) in such a manner that a bias is applied in addition to the electric power from the frequency current source (26). The electroconductive substrate (24), set on the electrode (25), is arranged such that it can be heated to, for example, 350° C. by a heating means (not illustrated).

When a photosensitive member illustrated in FIG. 1, for example, is prepared with $C_2H_4$ gas, $H_2$ gas as a carrier gas and $SiH_4$ gas the gases may be supplied from the first tank (6), the second tank (7) and the fourth tank (9) respectively through the main pipe (21) after the reactor is maintained at a constant vacuum. Then an electric power of 0.03–1 kw is applied from the frequency current source (26) to the electrode (22) to cause plasma discharge between both electrodes to form a C:H adhesive layer (2) containing Si of 0.01–5 μm thick on a preheated substrate (24). A content of C and Si may have a gradient. Then, $C_2H_4$ gas and $H_2$ gas are supplied from the first tank and the second tank respectively and plasma charge is applied to form a C:H charge transporting layer (2) of 5–50 μm in thickness. The hydrogen content of the C:H charge transporting layer depends on production conditions such as the kind of starting material, the ratio of the material and the diluting gas ($H_2$ gas or inert gas such as He), discharging power, pressure, substrate temperature, DC bias, anneal temperature, and the frequency at discharge. The hydrogen content can be controlled by varying the bias from 0.05 to 1 kv. That is, the hydrogen content can be reduced by applying a higher bias so as to increase the hardness of the C:H layer. The C:H charge transporting layer obtained has excellent light transmittance, dark resistance and carrier transportability. The layer may be controlled to be a P type by the introduction of $B_2H_6$ gas from the third tank (8) and $N_2O$ gas from 5th tank (10) to improve the charge transportability still more. If $PH_3$ gas is used instead of $B_2H_6$, the layer can be controlled to be an N type.

As a charge generating layer (3) a layer mainly made of a-Si may be applied by introduction of $H_2$ gas and $SiH_4$ from the 2nd tank (7) and the 4th tank (9) respectively.

The egopt is dependent on the kind of starting gaseous materials, the ratio of the starting materials and the diluting gas ($H_2$ and inert gas etc.), charging power, pressure, substrate temperature, DC bias, anneal temperature, discharging frequency and the like. Discharging power, substrate temperature especially and anneal temperature affect the Egopt.

The egopt of the present invention can be calculated from the absorption edge by the formula of $\sqrt{\alpha h\nu - h\nu}$ wherein $\alpha$ represents the absorption coefficient and $h\nu$ represents light energy.

The relative dielectric constant of the C:H charge transporting layer is depended on the kind of starting gaseous material, the DC bias generated by discharge or applied from outside, the discharging power and the like, and can be controlled by changing them.

Figure 16:
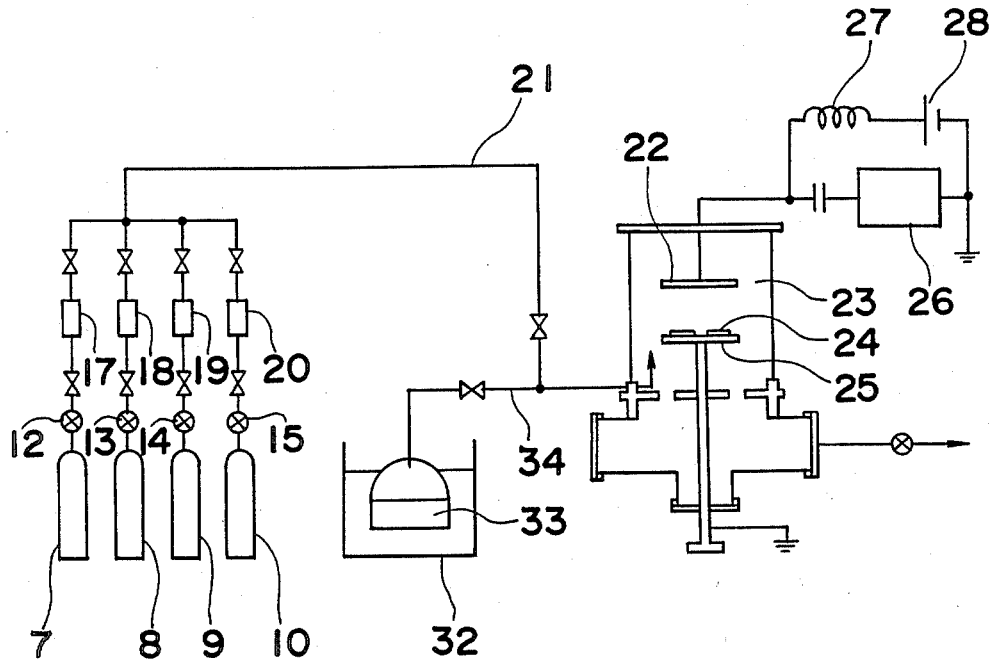

A capacitance coupling CVD apparatus as shown in FIG. 16 illustrates an embodiment using a monomer such as $C_8H_8$ as a source of the C:H charge transporting layer, in which the monomer (33) in a constant temperature bath (32) as well as the pipe (34) connected to the reactor, is heated for introduction into the reactor (23) as a vapor. The other constitutions are the same as FIG. 14.

The photosensitive member of the present invention has excellent charge transportance and charging capacity, and a sufficient surface potential can be obtained even when the thickness of the C:H charge transporting layer is thin.

The production costs are low, and the production time is short, because the raw material costs are low, every layer can be formed in the same reactor, and the layers may be thin. Even a thin C:H charge transporting layer can be produced without pin holes. If the C:H charge transporting layer of the present invention is used as an outermost surface, durability of the photosensitive member is improved because of its excellent resistance to corona, acids, moisture, heat and rigidity.

The present invention is illustrated by the following examples, but it should not be construed restrictively to them.

EXAMPLE 1

(I) Formation of C:H Adhesive Layer

In the glow discharge decomposition apparatus shown in FIG. 14, the reactor (23) is evacuated to a high vacuum of about $10^{-6}$ Torr, and then the 1st, 2nd, 3rd and 4th controlling valves (11)–(14) were opened to send $C_2H_4$ gas from the 1st tank (6), $H_2$ gas from the 2nd tank (7), $B_2H_6$ gas from the 3rd tank (8) and $SiH_4$ gas from the 4th tank (9) through mass flow controllers (16)–(19) respectively under the flow rate shown in Table 1 to the reactor (23). After the flow rate of every gas was stabilized, the inner pressure of the reactor was adjusted to 1.0 Torr. Separately, an aluminum plate of 3×50×50 mm, the electroconductive substrate (24), was preheated to 250° C. When both the flow rate of the gases and the inner pressure were stabilized, a high-frequency power of 15 watts (frequency, 13.56 MHz) was applied to the electrode (22) from the power source (26) to continue plasma polymerization for 20 minutes to form the C:H adhesive layer on the substrate (24). The flow rates of gasses, the condition for production and the properties of the layer are shown in Table 1.

(II) FORMATION of C:H Charge Transporting Layer

The application of power from the frequency power source was temporarily stopped, and the reactor was evacuated to $10^{-2}$ Torr.

The 1st and 2nd controlling valves (11) and (12) were opened to send $C_2H_4$ gas from the first tank (6) and $H_2$ gas from the 2nd tank (7) through mass flow controllers (16) and (17) respectively to the reactor (23). After the flow rate of every gas was stabilized, the inner pressure of the reactor was adjusted to 1.0 Torr, and a high-frequency power of 100 Watts was applied to the electrode (22) from the power source (26) to continue plasma polymerization.

The flow rate of gases, the productive conditions of the layer are shown in Table 1.

(III) Formation of a-Si Charge Generating Layer

The application of power from the high frequency power source (26) was temporarily stopped, and the reactor was evacuated.

4th and 2nd controlling valves (14) and (12) were opened to sent $SiH_4$ gas from 4th tank (9) and $H_2$ gas from the 2nd tank (7) through mass flow controllers (19) and (17) respectively under the flow rates shown in Table 1 to the reactor. After the flow rates were stabilized, the inner pressure of the reactor (23) was adjusted to 1.0 Torr.

When the flow rate and the inner pressure were stabilized, a high frequency power (frequency, 13.56 MHz) of 10 watts was applied to the substrate with the C:H charge transporting layer from the electrode (22) to generate the glow discharge. The conditions for production and the properties of the resultant photosensitive member are shown in Table 1, in which the residual potential and the stability of repetition are evaluated as excellent (O), good (Δ), unacceptable (X). The stability of repetition means that the stability of properties under repetition of charging and exposing the photosensitive member. In addition, the separateness are evaluated as follows:

O: no separation,
Δ: partial separation,
X: entire separation.

TABLE 1

| | adhesive layer | CTL(2) | CGL(3) |
|---|---|---|---|
| $C_2H_4$ (sccm) | 240 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 20 (minute) | 5 (hour) | 40 (minute) |
| thickness of layer (μm) | 0.17 | 5.5 | 0.5 |
| C content (atomic %) $= \frac{C}{C + Si}$ | 70 | 100 | 0 |
| hydrogen content (atomic %) $= \frac{H}{\text{all atoms}}$ | 50 | 60 | 20 |
| Si content (atomic %) $= \frac{Si}{C + Si}$ | 30 | 0 | — |
| $V_0$ (V) | | −340 | |
| $E_{\frac{1}{2}}$ (lux.sec) | | 2.9 | |
| separateness(1) | | no separation | |
| residual potential Vr (V) | | o | |
| repetition stability | | o | |
| adhesivity of the adhesive layer to CTL | | o | |

(1)adhesive properties of an adhesive layer with a substrate after left alone overnight in condition of 30° C.; 85% RH.
(2)charge transporting layer (abbreviated to CTL hereinafter)
(3)charge generating layer (abbreviated to CGL hereinafter)

EXAMPLE 2–34

Photosensitive members were prepared in a similar way as Example 1 according to the conditions shown in Table 2–34. The properties of resultant photosensitive members are shown in Table 2–34.

In Example 23 shown in Table 23, a charge generating layer was formed as mentioned below.

| Formulation | parts by weight |
|---|---|
| styrene | 200 |
| methyl methacrylate | 160 |
| n-butyl acrylate | 75 |
| β-hydroxypropyl acrylate | 55 |
| maleic acid | 8 |
| benzoyl peroxide | 7.5 |
| ethylene glycol monomethyl ether | 150 |

The mixture obtained from the above formulation was added dropewise to a reaction vessel containing xylene (350 parts by weight) with stirring under nitrogen circumstances at 105° C. for 2 hours to react. After 2.5 hours elapsed since the initiation of the polymerization an additional, benzoyl peroxide (0.5 part by weight) was added to react for 8 hours as stirring under heating to give a thermoset hydroxyl-containing acrylic resin (viscosity: 800 cps, solid: 50%).

The thermoset hydroxyl-containing acrylic resin (34 parts by weight), melamine resin (Super Beckamine J 820; available from Dainippon Ink & Chemicals Inc.) (6 parts by weight), 2,4,5,7-tetranitro-9-fluorenone (0.5 parts by weight), epsilon-copper phthalocyanine available from Toyo Ink Co., Ltd. (20 parts by weight), cellosolve acetate (40 parts by weight) and methyl ethyl ketone (40 parts by weight) were blended in a ball mill pot for 30 hours to give a photoelectroconductive paint. The obtained paint was coated on the surface of a C:H charge transporting layer obtained by the manner as described in Example 23, dried and then cured to give a photosensitive member for electrophotography. The member had an electrophotoconductive layer of 1 μm in thickness. The results are shown in Table 23.

TABLE 2

| | adhesive layer | CTL | CGL |
|---|---|---|---|
| $C_2H_4$ (sccm) | 60 | 60 | 0 |
| $H_2$ (sccm) | 180 | 80 | 210 |
| $GeH_4$ (sccm) | 60 | 0 | 0 |
| $SiH_4$ (sccm) | 0 | 0 | 90 |
| Power (W) | 10 | 100 | 10 |
| inner pressure of reactor (Torr) | 1.0 | 1.0 | 1.0 |
| time | 5 (minute) | 5 (hour) | 40 (minute) |
| thickness of layer (μm) | 0.16 | 5.5 | 0.5 |
| C content (atomic %) $= \frac{C}{Ge + C}$ | 40 | 100 | 0 |
| hydrogen content (atomic %) $= \frac{H}{\text{all atoms}}$ | 35 | 60 | 20 |
| Ge content (atomic %) $= \frac{C}{Si + C}$ | 60 | 0 | 0 |
| $V_0$ (V) | | −290 | |
| $E_{\frac{1}{2}}$ (lux.sec) | | 2.6 | |
| separateness(1) | | no separation | |
| residual potential Vr (V) | | o | |
| repetition stability | | o | |
| adhesivity of the adhesive layer to CTL | | o | |

(1)the same manner as Table 1

TABLE 3

| | adhesive layer | CTL | CGL |
|---|---|---|---|
| $C_2H_4$ (sccm) | 60 | 60 | 0 |
| $H_2$ (sccm) | 100 | 80 | 210 |
| $SiH_4$ (sccm) | 60 → 0(4) | 0 | 90 |
| $B_2H_6 + H_2$ (sccm) | 0 | 0 | 0 |
| $B_2H_6/SiH_4$ (ppm) | 0 | — | 0 |
| Power (W) | 60 | 100 | 10 |
| inner pressure of reactor (Torr) | 1.0 | 1.0 | 1.0 |
| time | 5 (minute) | 5 (hour) | 40 (minute) |
| thickness of layer (μm) | 0.16 | 5.5 | 0.5 |
| C content (atomic %) $= \frac{C}{Si + C}$ | 40 → 100 | 100 | 0 |
| hydrogen content (atomic %) $= \frac{H}{\text{all atoms}}$ | 35 → 60 | 60 | 20 |
| Si content (atomic %) $= \frac{Si}{C + Si}$ | 60 → 0 | — | — |
| $V_0$ (V) | | −340 | |
| $E_{\frac{1}{2}}$ (lux.sec) | | 2.8 | |
| separateness(1) | | no separation | |
| residual potential Vr (V) | | o | |
| repetition stability | | o | |
| adhesivity of the adhesive layer to CTL | | o | |

(1)the same manner as Table 1
(4)gradual change from 60 sccm to 0 sccm for 5 minutes.

TABLE 4

| | adhesive layer | CTL | CGL |
|---|---|---|---|
| $C_2H_4$ (sccm) | 240 | 60 | 0 |
| $H_2$ (sccm) | 100 | 80 | 210 |
| $SiH_4$ (sccm) | 7 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 30 (minute) | 5 (hour) | 40 (minute) |
| thickness of layer (μm) | 0.17 | 5.5 | 0.5 |
| C content (atomic %) $= \frac{C}{C + Si}$ | 95 | 100 | 0 |
| hydrogen content (atomic %) $= \frac{H}{\text{all atoms}}$ | 54 | 60 | 20 |
| Si content (atomic %) $= \frac{Si}{C + Si}$ | 5 | — | — |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 5

| | adhesive layer | CTL | CGL |
|---|---|---|---|
| $C_2H_4$ (sccm) | 240 | 60 | 0 |
| $H_2$ (sccm) | 100 | 80 | 210 |
| $SiH_4$ (sccm) | 34 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 33 (minute) | 5 (hour) | 40 (minute) |
| thickness of layer (μm) | 0.17 | 5.5 | 0.5 |
| C content (atomic %) $= \frac{C}{C + Si}$ | 80 | 100 | 0 |
| hydrogen content (atomic %) $= \frac{H}{\text{all atoms}}$ | 52 | 60 | 20 |
| Si content (atomic %) $= \frac{Si}{C + Si}$ | 20 | — | — |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the ad- | | o | |

TABLE 5-continued

| | adhesive layer | CTL | CGL |
|---|---|---|---|
| hesive layer to CTL | | | |

(1)the same manner as Table 1

TABLE 6

| | adhesive layer | CTL | CGL |
|---|---|---|---|
| $C_2H_4$ (sccm) | 100 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 17 (minute) | 5 (hour) | 40 (minute) |
| thickness of layer (μm) | 0.17 | 5.5 | 0.5 |
| C content (atomic %) $= \frac{C}{C + Si}$ | 50 | 100 | 0 |
| hydrogen content (atomic %) $= \frac{H}{\text{all atoms}}$ | 44 | 60 | 20 |
| Si content (atomic %) $= \frac{Si}{C + Si}$ | 50 | — | — |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 7

| | adhesive layer | CTL | CGL |
|---|---|---|---|
| $C_2H_4$ (sccm) | 25 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 14 (minute) | 5 (hour) | 40 (minute) |
| thickness of layer (μm) | 0.17 | 5.5 | 0.5 |
| C content (atomic %) $= \frac{C}{C + Si}$ | 20 | 100 | 0 |
| hydrogen content (atomic %) $= \frac{H}{\text{all atoms}}$ | 31 | 60 | 20 |
| Si content (atomic %) $= \frac{Si}{C + Si}$ | 80 | — | — |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 8

| | adhesive layer | CTL | CGL |
|---|---|---|---|
| $C_2H_4$ (sccm) | 3 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 12 (minute) | 5 (hour) | 40 (minute) |
| thickness of layer (μm) | 0.17 | 5.5 | 0.5 |
| C content (atomic %) $= \frac{C}{C + Si}$ | 5 | 100 | 0 |
| hydrogen content (atomic %) $= \frac{H}{\text{all atoms}}$ | 22 | 60 | 20 |
| Si content (atomic %) $= \frac{Si}{C + Si}$ | 95 | — | — |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the adhesive layer to CTL | | Δ | |

(1)the same manner as Table 1

TABLE 9

| | adhesive layer | CTL | CGL |
|---|---|---|---|
| $C_2H_4$ (sccm) | 240 | 60 | 0 |
| $H_2$ (sccm) | 100 | 80 | 210 |
| $SiH_4$ (sccm) | 24 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 25 (minute) | 5 (hour) | 40 (minute) |
| thickness of layer (μm) | 0.17 | 5.5 | 0.5 |
| C content (atomic %) $= \frac{C}{C + Si}$ | 85 | 100 | 0 |
| hydrogen content (atomic %) $= \frac{H}{\text{all atoms}}$ | 53 | 60 | 20 |
| Si content (atomic %) $= \frac{Si}{C + Si}$ | 15 | — | — |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 10

| | adhesive layer | CTL | CGL |
|---|---|---|---|
| $C_2H_4$ (sccm) | 15 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |

TABLE 10-continued

| | adhesive layer | CTL | CGL |
|---|---|---|---|
| time | 13 (minute) | 5 (hour) | 40 (minute) |
| thickness of layer (μm) | 0.17 | 5.5 | 0.5 |
| C content (atomic %) $= \frac{C}{C + Si}$ | 15 | 100 | 0 |
| hydrogen content (atomic %) $= \frac{H}{\text{all atoms}}$ | 27 | 60 | 20 |
| Si content (atomic %) $= \frac{Si}{C + Si}$ | 85 | — | — |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 11

| | adhesive layer | CTL | CGL |
|---|---|---|---|
| $C_2H_4$ (sccm) | 60 | 60 | 0 |
| $H_2$ (sccm) | 180 | 80 | 210 |
| $SiH_4$ (sccm) | — | 0 | 90 |
| $GeH_4$ (sccm) | 2.5 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 35 (minute) | 5 (hour) | 40 (minute) |
| thickness of layer (μm) | 0.17 | 5.5 | 0.5 |
| C content (atomic %) $= \frac{C}{C + Ge}$ | 95 | 100 | 0 |
| hydrogen content (atomic %) $= \frac{H}{\text{all atoms}}$ | 54 | 60 | 20 |
| Ge content (atomic %) $= \frac{Ge}{C + Ge}$ | 5 | — | — |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 12

| | adhesive layer | CTL | CGL |
|---|---|---|---|
| $C_2H_4$ (sccm) | 60 | 60 | 0 |
| $H_2$ (sccm) | 180 | 80 | 210 |
| $SiH_4$ (sccm) | — | 0 | 90 |
| $GeH_4$ (sccm) | 8 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 29 (minute) | 5 (hour) | 40 (minute) |
| thickness of layer (μm) | 0.17 | 5.5 | 0.5 |
| C content (atomic %) $= \frac{C}{C + Ge}$ | 85 | 100 | 0 |

TABLE 12-continued

| | adhesive layer | CTL | CGL |
|---|---|---|---|
| hydrogen content (atomic %) $= \frac{H}{\text{all atoms}}$ | 51 | 60 | 20 |
| Ge content (atomic %) $= \frac{Ge}{C + Ge}$ | 15 | — | — |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 13

| | adhesive layer | CTL | CGL |
|---|---|---|---|
| $C_2H_4$ (sccm) | 60 | 60 | 0 |
| $H_2$ (sccm) | 180 | 80 | 210 |
| $SiH_4$ (sccm) | — | 0 | 90 |
| $GeH_4$ (sccm) | 11 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 25 (minute) | 5 (hour) | 40 (minute) |
| thickness of layer (μm) | 0.17 | 5.5 | 0.5 |
| C content (atomic %) $= \frac{C}{C + Ge}$ | 80 | 100 | 0 |
| hydrogen content (atomic %) $= \frac{H}{\text{all atoms}}$ | 49 | 60 | 20 |
| Ge content (atomic %) $= \frac{Ge}{C + Ge}$ | 20 | — | — |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 14

| | adhesive layer | CTL | CGL |
|---|---|---|---|
| $C_2H_4$ (sccm) | 60 | 60 | 0 |
| $H_2$ (sccm) | 180 | 80 | 210 |
| $SiH_4$ (sccm) | — | 0 | 90 |
| $GeH_4$ (sccm) | 28 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 12 (minute) | 5 (hour) | 40 (minute) |
| thickness of layer (μm) | 0.17 | 5.5 | 0.5 |
| C content (atomic %) $= \frac{C}{C + Ge}$ | 60 | 100 | 0 |
| hydrogen content (atomic %) $= \frac{H}{\text{all atoms}}$ | 42 | 60 | 20 |
| Ge content (atomic %) $= \frac{Ge}{C + Ge}$ | 40 | — | — |
| $V_0$ (V) | | −340 | |
| $E_{\frac{1}{2}}$ (lux.sec) | | 2.8 | |

TABLE 14-continued

| | adhesive layer | CTL | CGL |
|---|---|---|---|
| separateness[1] | | no separation (o) | |
| residual potential Vr (V) | | o | |
| repetition stability | | o | |
| adhesivity of the adhesive layer to CTL | | o | |

[1]the same manner as Table 1

TABLE 15

| | adhesive layer | CTL | CGL |
|---|---|---|---|
| $C_2H_4$ (sccm) | 21 | 60 | 0 |
| $H_2$ (sccm) | 180 | 80 | 210 |
| $SiH_4$ (sccm) | — | 0 | 90 |
| $GeH_4$ (sccm) | 60 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 5 (minute) | 5 (hour) | 40 (minute) |
| thickness of layer (μm) | 0.17 | 5.5 | 0.5 |
| C content (atomic %) $= \frac{C}{C + Ge}$ | 20 | 100 | 0 |
| hydrogen content (atomic %) $= \frac{H}{\text{all atoms}}$ | 28 | 60 | 20 |
| Ge content (atomic %) $= \frac{Ge}{C + Ge}$ | 80 | — | — |
| $V_0$ (V) | | −340 | |
| $E_{\frac{1}{2}}$ (lux.sec) | | 2.8 | |
| separateness[1] | | no separation (o) | |
| residual potential Vr (V) | | o | |
| repetition stability | | o | |
| adhesivity of the adhesive layer to CTL | | o | |

[1]the same manner as Table 1

TABLE 16

| | adhesive layer | CTL | CGL |
|---|---|---|---|
| $C_2H_4$ (sccm) | 15 | 60 | 0 |
| $H_2$ (sccm) | 180 | 80 | 210 |
| $SiH_4$ (sccm) | — | 0 | 90 |
| $GeH_4$ (sccm) | 60 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 5 (minute) | 5 (hour) | 40 (minute) |
| thickness of layer (μm) | 0.17 | 5.5 | 0.5 |
| C content (atomic %) $= \frac{C}{C + Ge}$ | 15 | 100 | 0 |
| hydrogen content (atomic %) $= \frac{H}{\text{all atoms}}$ | 26 | 60 | 20 |
| Ge content (atomic %) $= \frac{Ge}{C + Ge}$ | 85 | — | — |
| $V_0$ (V) | | −340 | |
| $E_{\frac{1}{2}}$ (lux.sec) | | 2.8 | |
| separateness[1] | | no separation | |
| residual potential Vr (V) | | o | |
| repetition stability | | o | |
| adhesivity of the adhesive layer to CTL | | Δ | |

[1]the same manner as Table 1

TABLE 17

| | adhesive layer | CTL | CGL |
|---|---|---|---|
| $C_2H_4$ (sccm) | 4 | 60 | 0 |
| $H_2$ (sccm) | 180 | 80 | 210 |
| $SiH_4$ (sccm) | — | 0 | 90 |
| $GeH_4$ (sccm) | 60 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 5 (minute) | 5 (hour) | 40 (minute) |
| thickness of layer (μm) | 0.17 | 5.5 | 0.5 |
| C content (atomic %) $= \frac{C}{C + Ge}$ | 5 | 100 | 0 |
| hydrogen content (atomic %) $= \frac{H}{\text{all atoms}}$ | 22 | 60 | 20 |
| Ge content (atomic %) $= \frac{Ge}{C + Ge}$ | 95 | — | — |
| $V_0$ (V) | | −340 | |
| $E_{\frac{1}{2}}$ (lux.sec) | | 2.8 | |
| separateness[1] | | no separation (o) | |
| residual potential Vr (V) | | o | |
| repetition stability | | o | |
| adhesivity of the adhesive layer to CTL | | Δ | |

[1]the same manner as Table 1

TABLE 18

| | adhesive layer | CTL | CGL |
|---|---|---|---|
| $C_2H_4$ (sccm) | 60 | 60 | 0 |
| $H_2$ (sccm) | 80 | 80 | 210 |
| $SiH_4$ (sccm) | — | 0 | 90 |
| $(CH_3)_3Al$ (sccm) | 12 | 0 | 0 |
| $B_2H_6/SiH_4$ (ppm) | — | — | 0 |
| Power (W) | 30 | 100 | 10 |
| inner pressure of reactor (Torr) | 0.5 | 1.0 | 1.0 |
| time | 30 (minute) | 5 (hour) | 40 (minute) |
| thickness of layer (μm) | 0.17 | 5.5 | 0.5 |
| C content (atomic %) $= \frac{C}{C + Al}$ | 95 | 100 | 0 |
| hydrogen content (atomic %) $= \frac{H}{\text{all atoms}}$ | 54 | 60 | 20 |
| $V_0$ (V) | | −340 | |
| $E_{\frac{1}{2}}$ (lux.sec) | | 2.8 | |
| separateness[1] | | no separation (Δ) | |
| residual potential Vr (V) | | o | |
| repetition stability | | o | |
| adhesivity of the adhesive layer to CTL | | o | |

[1]the same manner as Table 1

TABLE 19

| | adhesive layer | CTL | CGL |
|---|---|---|---|
| $C_2H_4$ (sccm) | 60 | 60 | 0 |
| $H_2$ (sccm) | 80 | 80 | 210 |

TABLE 19-continued

| | adhesive layer | CTL | CGL |
|---|---|---|---|
| $SiH_4$ (sccm) | — | 0 | 90 |
| $(CH_3)_3Al$ (sccm) | 30 | 0 | 0 |
| $B_2H_6/SiH_4$ (ppm) | — | — | 0 |
| Power (W) | 30 | 100 | 10 |
| inner pressure of reactor (Torr) | 0.5 | 1.0 | 1.0 |
| time | 30 (minute) | 5 (hour) | 40 (minute) |
| thickness of layer (μm) | 0.17 | 5.5 | 0.5 |
| C content (atomic %) $= \frac{C}{C + Al}$ | 90 | 100 | 0 |
| hydrogen content (atomic %) $= \frac{H}{\text{all atoms}}$ | 52 | 60 | 20 |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 20

| | adhesive layer | CTL | CGL |
|---|---|---|---|
| $C_2H_4$ (sccm) | 30 | 60 | 0 |
| $H_2$ (sccm) | 80 | 80 | 210 |
| $SiH_4$ (sccm) | — | 0 | 90 |
| $(CH_3)_3Al$ (sccm) | 60 | 0 | 0 |
| $B_2H_6/SiH_4$ (ppm) | — | — | 0 |
| Power (W) | 30 | 100 | 10 |
| inner pressure of reactor (Torr) | 0.5 | 1.0 | 1.0 |
| time | 30 (minute) | 5 (hour) | 40 (minute) |
| thickness of layer (μm) | 0.17 | 5.5 | 0.5 |
| C content (atomic %) $= \frac{C}{C + Al}$ | 80 | 100 | 0 |
| hydrogen content (atomic %) $= \frac{H}{\text{all atoms}}$ | 47 | 60 | 20 |
| $V_0$ (V) | | −340 | |
| $E_{\frac{1}{2}}$ (lux.sec) | | 2.8 | |
| separateness(1) | | no separation (Δ) | |
| residual potential Vr (V) | | o | |
| repetition stability | | o | |
| adhesivity of the adhesive layer to CTL | | o | |

(1)the same manner as Table 1

TABLE 21

| | adhesive layer | CTL | CGL |
|---|---|---|---|
| $C_2H_4$ (sccm) | 0 | 60 | 0 |
| $H_2$ (sccm) | 80 | 80 | 210 |
| $SiH_4$ (sccm) | 100 | 0 | 90 |
| $(CH_3)_3Al$ (sccm) | 60 | 0 | 0 |
| $B_2H_6/SiH_4$ (ppm) | 0 | — | 0 |
| Power (W) | 30 | 100 | 10 |
| inner pressure of reactor (Torr) | 0.5 | 1.0 | 1.0 |
| time | 30 (minute) | 5 (hour) | 40 (minute) |
| thickness of layer (μm) | 0.17 | 5.5 | 0.5 |
| C content (atomic %) $= \frac{C}{C + Al}$ | 70 | 100 | 0 |

TABLE 21-continued

| | adhesive layer | CTL | CGL |
|---|---|---|---|
| hydrogen content (atomic %) $= \frac{H}{\text{all atoms}}$ | 43 | 60 | 20 |
| $V_0$ (V) | | −340 | |
| $E_{\frac{1}{2}}$ (lux.sec) | | 2.8 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 22

| | adhesive layer | CTL | CGL |
|---|---|---|---|
| $C_2H_4$ (sccm) | 100 | 30 | 0 |
| $H_2$ (sccm) | — | 40 | 210 |
| $SiH_4$ (sccm) | 60 | 0 | 90 |
| $B_2H_6 + H_2$ (sccm) | 100 | 0 | 0 |
| $B_2H_6/SiH_4$ (ppm) | 200 | — | 0 |
| Power (W) | 15 | 100 | 10 |
| inner pressure of reactor (Torr) | 1.0 | 0.5 | 1.0 |
| time | 17 (minute) | 4 (hour) | 40 (minute) |
| thickness of layer (μm) | 0.17 | 5 | 0.5 |
| C content (atomic %) $= \frac{C}{C + Si}$ | 50 | 100 | 0 |
| hydrogen content (atomic %) $= \frac{H}{\text{all atoms}}$ | 44 | 50 | 20 |
| Si content (atomic %) $= \frac{Si}{C + Si}$ | 50 | — | — |
| $V_0$ (V) | | −350 | |
| $E_{\frac{1}{2}}$ (lux.sec) | | 2.1 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 23

| | adhesive layer | CTL | CGL |
|---|---|---|---|
| $C_2H_4$ (sccm) | 100 | 30 | |
| $H_2$ (sccm) | 100 | 40 | |
| $SiH_4$ (sccm) | 60 | 0 | |
| $B_2H_6 + H_2$ (sccm) | 0 | 0 | |
| $B_2H_6/SiH_4$ (ppm) | 0 | — | |
| Power (W) | 15 | 100 | |
| inner pressure of reactor (Torr) | 1.0 | 0.5 | |
| time | 17 (minute) | 4 (hour) | |
| thickness of layer (μm) | 0.17 | 5 | |
| C content (atomic %) $= \frac{C}{C + Si}$ | 50 | 100 | |
| hydrogen content (atomic %) $= \frac{H}{\text{all atoms}}$ | 44 | 50 | |
| Si content (atomic %) $= \frac{Si}{C + Si}$ | 50 | — | |
| $V_0$ (V) | | +300 | |
| $E_{\frac{1}{2}}$ (lux.sec) | | 5.1 | |
| separateness(1) | | no separation (o) | |
| residual potential Vr (V) | | o | |

TABLE 23-continued

| | adhesive layer | CTL | CGL |
|---|---|---|---|
| repetition stability | | o | |
| adhesivity of the adhesive layer to CTL | | o | |

(1)the same manner as Table 1

TABLE 24

| | adhesive layer | CTL | CGL |
|---|---|---|---|
| $C_2H_4$ (sccm) | 100 | 30 | 0 |
| $H_2$ (sccm) | 100 | 40 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 0.5 | 1.0 |
| time | 17 (minute) | 8 (hour) | 40 (minute) |
| thickness of layer (μm) | 0.17 | 5.7 | 0.5 |
| C content (atomic %) $= \frac{C}{C + Si}$ | 50 | 100 | 0 |
| hydrogen content (atomic %) $= \frac{H}{\text{all atoms}}$ | 44 | 40 | 20 |
| Si content (atomic %) $= \frac{Si}{C + Si}$ | 50 | — | — |
| $V_0$ (V) | | −380 | |
| $E_{\frac{1}{2}}$ (lux.sec) | | 2.1 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 25

| | adhesive layer | CTL | CGL |
|---|---|---|---|
| $C_2H_4$ (sccm) | 100 | 90 | 0 |
| $H_2$ (sccm) | 100 | 120 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 300 | 10 |
| inner pressure of reactor (Torr) | 1.0 | 0.5 | 1.0 |
| time | 17 (minute) | 8 (hour) | 40 (minute) |
| thickness of layer (μm) | 0.17 | 17 | 0.5 |
| C content (atomic %) $= \frac{C}{C + Si}$ | 50 | 100 | 0 |
| hydrogen content (atomic %) $= \frac{H}{\text{all atoms}}$ | 44 | 49 | 20 |
| Si content (atomic %) $= \frac{Si}{C + Si}$ | 30 | — | — |
| $V_0$ (V) | | −540 | |
| $E_{\frac{1}{2}}$ (lux.sec) | | 3.6 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 26

| | adhesive layer | CTL | CGL |
|---|---|---|---|
| $C_2H_4$ (sccm) | 100 | 180 | 0 |
| $H_2$ (sccm) | 100 | 240 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 600 | 10 |
| inner pressure of reactor (Torr) | 1.0 | 0.5 | 1.0 |
| time | 17 (minute) | 8 (hour) | 40 (minute) |
| thickness of layer (μm) | 0.17 | 16 | 0.5 |
| C content (atomic %) $= \frac{C}{C + Si}$ | 50 | 100 | 0 |
| hydrogen content (atomic %) $= \frac{H}{\text{all atoms}}$ | 44 | 37 | 20 |
| Si content (atomic %) $= \frac{Si}{C + Si}$ | 50 | — | — |
| $V_0$ (V) | | −500 | |
| $E_{\frac{1}{2}}$ (lux.sec) | | 5.1 | |
| separateness(1) | | no separation (o) | |
| residual potential Vr (V) | | o | |
| repetition stability | | o | |
| adhesivity of the adhesive layer to CTL | | o | |

(1)the same manner as Table 1

TABLE 27

| | adhesive layer | CTL | CGL |
|---|---|---|---|
| $C_2H_4$ (sccm) | 100 | 240 | 0 |
| $H_2$ (sccm) | 100 | 320 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 800 | 10 |
| inner pressure of reactor (Torr) | 1.0 | 0.5 | 1.0 |
| time | 17 (minute) | 8 (hour) | 40 (minute) |
| thickness of layer (μm) | 0.17 | 17 | 0.5 |
| C content (atomic %) $= \frac{C}{C + Si}$ | 50 | 100 | 0 |
| hydrogen content (atomic %) $= \frac{H}{\text{all atoms}}$ | 44 | 30 | 20 |
| Si content (atomic %) $= \frac{Si}{C + Si}$ | 50 | — | — |
| $V_0$ (V) | | −440 | |
| $E_{\frac{1}{2}}$ (lux.sec) | | 5.9 | |
| separateness(1) | | no separation (o) | |
| residual potential Vr (V) | | Δ | |
| repetition stability | | Δ | |
| adhesivity of the adhesive layer to CTL | | o | |

(1)the same manner as Table 1

TABLE 28

| | adhesive layer | CTL | CGL |
|---|---|---|---|
| $C_2H_4$ (sccm) | 100 | 100* | 0 |
| $H_2$ (sccm) | 100 | 100 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 600 | 10 |
| inner pressure of reactor (Torr) | 1.0 | 0.2 | 1.0 |

TABLE 28-continued

| | adhesive layer | CTL | CGL |
|---|---|---|---|
| time | 17 (minute) | 16 (hour) | 40 (minute) |
| thickness of layer (μm) | 0.17 | 5.2 | 0.5 |
| C content (atomic %) = C / (C + Si) | 50 | 100 | 0 |
| hydrogen content (atomic %) = H / all atoms | 44 | 41 | 20 |
| Si content (atomic %) = Si / (C + Si) | 50 | — | — |
| $V_0$ (V) | | −200 | |
| $E_{\frac{1}{2}}$ (lux.sec) | | 5.4 | |
| separateness(1) | | no separation (o) | |
| residual potential Vr (V) | | o | |
| repetition stability | | o | |
| adhesivity of the adhesive layer to CTL | | o | |

(1)the same manner as Table 1
*use of $CH_4$ gas

TABLE 29

| | adhesive layer | CTL | CGL |
|---|---|---|---|
| $C_2H_4$ (sccm) | 100 | 80* | 0 |
| $H_2$ (sccm) | 100 | 20 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 200 | 10 |
| inner pressure of reactor (Torr) | 1.0 | 1.0 | 1.0 |
| time | 17 (minute) | 6 (hour) | 40 (minute) |
| thickness of layer (μm) | 0.17 | 7.3 | 0.5 |
| C content (atomic %) = C / (C + Si) | 50 | 100 | 0 |
| hydrogen content (atomic %) = H / all atoms | 44 | 60 | 20 |
| Si content (atomic %) = Si / (C + Si) | 50 | — | — |
| $V_0$ (V) | | −470 | |
| $E_{\frac{1}{2}}$ (lux.sec) | | 5.8 | |
| separateness(1) | | no separation (o) | |
| residual potential Vr (V) | | Δ | |
| repetition stability | | Δ | |
| adhesivity of the adhesive layer to CTL | | o | |

(1)the same manner as Table 1
*use of $C_3H_8$ gas

TABLE 30

| | adhesive layer | CTL | CGL |
|---|---|---|---|
| $C_2H_4$ (sccm) | 100 | 180* | 0 |
| $H_2$ (sccm) | 100 | 120 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 500 | 10 |
| inner pressure of reactor (Torr) | 1.0 | 0.5 | 1.0 |
| time | 17 (minute) | 8 (hour) | 40 (minute) |
| thickness of layer (μm) | 0.17 | 10 | 0.5 |
| C content (atomic %) = C / (C + Si) | 50 | 100 | 0 |

TABLE 30-continued

| | adhesive layer | CTL | CGL |
|---|---|---|---|
| hydrogen content (atomic %) = H / all atoms | 44 | 45 | 20 |
| Si content (atomic %) = Si / (C + Si) | 50 | — | — |
| $V_0$ (V) | | −380 | |
| $E_{\frac{1}{2}}$ (lux.sec) | | 4.6 | |
| separateness(1) | | no separation (o) | |
| residual potential Vr (V) | | o | |
| repetition stability | | o | |
| adhesivity of the adhesive layer to CTL | | o | |

(1)the same manner as Table 1
*use of i-$C_4H_{10}$ gas

TABLE 31

| | adhesive layer | CTL | CGL |
|---|---|---|---|
| $C_2H_4$ (sccm) | 100 | 50* | 0 |
| $H_2$ (sccm) | 100 | 0 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 75 | 10 |
| inner pressure of reactor (Torr) | 1.0 | 0.25 | 1.0 |
| time | 17 (minute) | 2 (hour) | 40 (minute) |
| thickness of layer (μm) | 0.17 | 6.8 | 0.5 |
| C content (atomic %) = C / (C + Si) | 50 | 100 | 0 |
| hydrogen content (atomic %) = H / all atoms | 44 | 46 | 20 |
| Si content (atomic %) = Si / (C + Si) | 50 | — | — |
| $V_0$ (V) | | −430 | |
| $E_{\frac{1}{2}}$ (lux.sec) | | 2.3 | |
| separateness(1) | | no separation (o) | |
| residual potential Vr (V) | | o | |
| repetition stability | | o | |
| adhesivity of the adhesive layer to CTL | | o | |

(1)the same manner as Table 1
*use of $C_3H_6$ gas

TABLE 32

| | adhesive layer | CTL | CGL |
|---|---|---|---|
| $C_2H_4$ (sccm) | 100 | 30* | 0 |
| $H_2$ (sccm) | 100 | 30 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 5 | 10 |
| inner pressure of reactor (Torr) | 1.0 | $2 \times 10^{-3}$ | 1.0 |
| time | 17 (minute) | 8 (hour) | 40 (minute) |
| thickness of layer (μm) | 0.17 | 5 | 0.5 |
| C content (atomic %) = C / (C + Si) | 50 | 100 | 0 |
| hydrogen content (atomic %) = H / all atoms | 44 | 10 | 20 |
| Si content (atomic %) = Si / (C + Si) | 50 | — | — |

TABLE 32-continued

| | adhesive layer | CTL | CGL |
|---|---|---|---|
| $V_0$ (V) | | −300 | |
| $E_{\frac{1}{2}}$ (lux.sec) | | 2.3 | |
| separateness(1) | | no separation (o) | |
| residual potential $V_r$ (V) | | Δ | |
| repetition stability | | Δ | |
| adhesivity of the adhesive layer to CTL | | o | |

(1)the same manner as Table 1
*use of $CH_4$ gas

TABLE 33

| | adhesive layer | CTL | CGL |
|---|---|---|---|
| $C_2H_4$ (sccm) | 60 | 60 | 0 |
| $H_2$ (sccm) | 180 | 80 | 210 |
| $SiH_4$ (sccm) | — | 0 | 90 |
| $GeH_4$ (sccm) | 60 → 0 | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 22 (minute) | 5 (hour) | 40 (minute) |
| thickness of layer (μm) | 0.17 | 5.5 | 0.5 |
| C content (atomic %) $= \frac{C}{C + Si}$ | 40 → 100 | 100 | 0 |
| hydrogen content (atomic %) $= \frac{H}{\text{all atoms}}$ | 35 → 56 | 60 | 20 |
| $V_0$ (V) | | −300 | |
| $E_{\frac{1}{2}}$ (lux.sec) | | 2.7 | |
| separateness(1) | | no separation (o) | |
| residual potential $V_r$ (V) | | o | |
| repetition stability | | o | |
| adhesivity of the adhesive layer to CTL | | o | |

(1)the same manner as Table 1

TABLE 34

| | adhesive layer | CTL | CGL |
|---|---|---|---|
| $C_2H_4$ (sccm) | 240 | 60 | 0 |
| $H_2$ (sccm) | — | 80 | 210 |
| $SiH_4$ (sccm) | 2.5 | 0 | 90 |
| $B_2H_6 + H_2$ (sccm) | 100 | 0 | 0 |
| $B_2H_6/SiH_4$ (ppm) | 200 | — | 0 |
| Power (W) | 15 | 100 | 10 |
| inner pressure of reactor (Torr) | 1.0 | 1.0 | 1.0 |
| time | 33 (minute) | 5 (hour) | 40 (minute) |
| thickness of layer (μm) | 0.17 | 5.5 | 0.5 |
| C content (atomic %) $= \frac{C}{C + Si}$ | 98 | 100 | 0 |
| hydrogen content (atomic %) $= \frac{H}{\text{all atoms}}$ | 55 | 60 | 20 |
| Si content (atomic %) $= \frac{Si}{C + Si}$ | 2 | — | — |
| $V_0$ (V) | | −340 | |
| $E_{\frac{1}{2}}$ (lux.sec) | | 2.8 | |
| separateness(1) | | Δ | |
| residual potential $V_r$ (V) | | o | |
| repetition stability | | o | |
| adhesivity of the adhesive layer to CTL | | o | |

(1)the same manner as Table 1

COMPARATIVE EXAMPLE 1

An a-Si photosensitive member having an a-Si charge generating layer of 5 μm thick was prepared according to the same manner as the process (II) in Example 1, but the process (I) (formation of C:H adhesive layer) and the process (II) (preparation of C:H layer) were omitted.

The obtained photosensitive member had an initial surface potential (Vo) of −100 V and $E_{1/2}$ of 0.7 lux.-sec., but had an insufficient charging capacity at a positive polarity and gave an unclear copy. Residual potential and stability for repetition are unacceptable. An adhesive property is bad.

COMPARATIVE EXAMPLE 2

A photosensitive member was prepared by coating a polyethylene layer formed by the conventional organic polymerization on a substrate instead of the C:H layer prepared at the process (II) of Example 1 and then applying the process (III) to form a-Si layer (0.5 μm) on the coated layer. but the process (I) (formation of C:H adhesive layer) was omitted. The hydrogen content was 67 atm.% and initial surface potential was −600 V, but sensitivity was insufficient, that is, the reduction of potential by exposure did not reach to even a half value of the initial one. Residual potential and stability for repetition are unacceptable.

COMPARATIVE EXAMPLE 3

Figure 17:
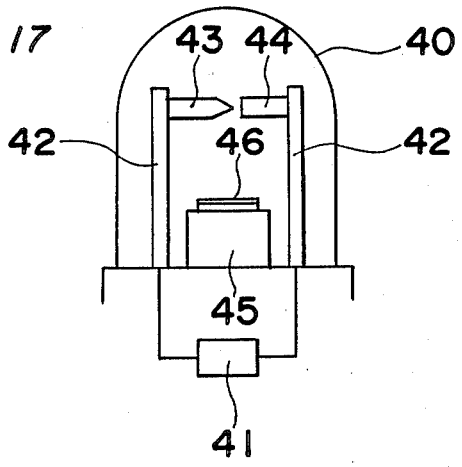
FIG. 17 shows an apparatus for arc deposition used in a comparative example.

A carbon layer not containing hydrogen was prepared using an arc discharge vapor deposition apparatus as shown in FIG. 17, in which an electrode supporting rods (42) and (44) connected with an power source (41) were equipped in a vacuum container (40), an Al substrate (46) was placed on a supporter for a substrate (45) having carbon electrodes (43) and (44), and an arc discharge was generated under a container pressure of $10^{-5}$ Torr and an electric current to carbon electrode of 50 Å to deposit a carbon layer not containing hydrogen in a thickness of 5 μm on the Al substrate.

The obtained carbon layer had a resistance of less than $10^8$ Ω.cm not to be used as a photosensitive member for electrophotography.

When an a-Si layer (0.5 μm) was formed on the carbon layer under the same condition as in Example 1, the a-Si layer was exfoliated from the carbon layer.

COMPARATIVE EXAMPLE 4

A photosensitive member is prepared according to the same manner as Example 1–3, but an adhesive layer is omitted.

A C:H charge transporting layer and 5.5 μm in thickness. A charge generation layer is a-Si layer and 0.5 μm in thickness.

The resultant photosensitive member is left overnight in the condition of 30° C. and 85% RH.

The C:H charge transporting layer was exfoliated from the Al substrate.

COMPARATIVE EXAMPLE 5-13

Photosensitive member shown in Table 35-43 are prepared according to Example.

TABLE 35

| | adhesive layer | CTL | CGL |
|---|---|---|---|
| $C_2H_4$ (sccm) | 0 | 60 | 0 |
| $H_2$ (sccm) | 100 | 80 | 210 |
| $SiH_4$ (sccm) | 60 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 11 (minute) | 5 (hour) | 40 (minute) |
| thickness of layer (μm) | 0.17 | 5.5 | 0.5 |
| C content (atomic %) $= \frac{C}{C + Si}$ | 0 | 100 | 0 |
| hydrogen content (atomic %) $= \frac{H}{\text{all atoms}}$ | 20 | 60 | 20 |
| Si content (atomic %) $= \frac{Si}{C + Si}$ | 100 | — | — |
| $V_0$ (V) | | — | |
| $E_{\frac{1}{2}}$ (lux.sec) | | — | |
| separateness(1) | | o | |
| residual potential Vr (V) | | — | |
| repetition stability | | — | |
| adhesivity of the adhesive layer to CTL | | x | |

(1)the same manner as Table 1

TABLE 36

| | adhesive layer | CTL | CGL |
|---|---|---|---|
| $C_2H_4$ (sccm) | 240 | 60 | 0 |
| $H_2$ (sccm) | — | 80 | 210 |
| $SiH_4$ (sccm) | 0 | 0 | 90 |
| $B_2H_6 + H_2$ (sccm) | 0 | 0 | 0 |
| $B_2H_6/SiH_4$ (ppm) | 0 | — | 0 |
| Power (W) | 15 | 100 | 10 |
| inner pressure of reactor (Torr) | 1.0 | 1.0 | 1.0 |
| time | 36 (minute) | 5 (hour) | 40 (minute) |
| thickness of layer (μm) | 0.17 | 5.5 | 0.5 |
| C content (atomic %) $= \frac{C}{C + Si}$ | — | 100 | 0 |
| hydrogen content (atomic %) $= \frac{H}{\text{all atoms}}$ | 56 | 60 | 20 |
| Si content (atomic %) $= \frac{Si}{C + Si}$ | 0 | — | — |
| $V_0$ (V) | | — | |
| $E_{\frac{1}{2}}$ (lux.sec) | | — | |
| separateness(1) | | x | |
| residual potential Vr (V) | | — | |
| repetition stability | | — | |
| adhesivity of the adhesive layer to CTL | | o | |

(1)the same manner as Table 1

TABLE 37

| | adhesive layer | CTL | CGL |
|---|---|---|---|
| $C_2H_4$ (sccm) | 60 | 60 | 0 |
| $H_2$ (sccm) | 180 | 80 | 210 |
| $GeH_4$ (sccm) | 1 | 0 | 90* |

TABLE 37-continued

| | adhesive layer | CTL | CGL |
|---|---|---|---|
| $B_2H_6 + H_2$ (sccm) | 0 | 0 | 0 |
| $B_2H_6/SiH_4$ (ppm) | 0 | — | 0 |
| Power (W) | 10 | 100 | 10 |
| inner pressure of reactor (Torr) | 1.0 | 1.0 | 1.0 |
| time | 36 (minute) | 5 (hour) | 40 (minute) |
| thickness of layer (μm) | 0.17 | 5.5 | 0.5 |
| C content (atomic %) $= \frac{C}{C + Si}$ | — | 100 | 0 |
| hydrogen content (atomic %) $= \frac{H}{\text{all atoms}}$ | 55 | 60 | 20 |
| Ge content (atomic %) $= \frac{Ge}{C + Ge}$ | 2 | — | — |
| $V_0$ (V) | | — | |
| $E_{\frac{1}{2}}$ (lux.sec) | | — | |
| separateness(1) | | x | |
| residual potential Vr (V) | | — | |
| repetition stability | | — | |
| adhesivity of the adhesive layer to CTL | | o | |

(1)the same manner as Table 1
*use of $SiH_4$

TABLE 38

| | adhesive layer | CTL | CGL |
|---|---|---|---|
| $C_2H_4$ (sccm) | 0 | 60 | 0 |
| $H_2$ (sccm) | 180 | 80 | 210 |
| $GeH_4$ (sccm) | 60 | 0 | 90* |
| $B_2H_6 + H_2$ (sccm) | — | 0 | 0 |
| $B_2H_6/SiH_4$ (ppm) | — | — | 0 |
| Power (W) | 10 | 100 | 10 |
| inner pressure of reactor (Torr) | 1.0 | 1.0 | 1.0 |
| time | 5 (minute) | 5 (hour) | 40 (minute) |
| thickness of layer (μm) | 0.17 | 5.5 | 0.5 |
| C content (atomic %) $= \frac{C}{C + Ge}$ | — | 100 | 0 |
| hydrogen content (atomic %) $= \frac{H}{\text{all atoms}}$ | 20 | 60 | 20 |
| Ge content (atomic %) $= \frac{Ge}{C + Ge}$ | 100 | — | — |
| $V_0$ (V) | | — | |
| $E_{\frac{1}{2}}$ (lux.sec) | | — | |
| separateness(1) | | o | |
| residual potential Vr (V) | | — | |
| repetition stability | | — | |
| adhesivity of the adhesive layer to CTL | | x | |

(1)the same manner as Table 1
*use of $SiH_4$

TABLE 39

| | adhesive layer | CTL | CGL |
|---|---|---|---|
| $C_2H_4$ (sccm) | 60 | 60 | 0 |
| $H_2$ (sccm) | 80 | 80 | 210 |
| $(CH_3)_3Al$ (sccm) | 6 | 0 | 90* |
| $B_2H_6 + H_2$ (sccm) | — | 0 | 0 |
| $B_2H_6/SiH_4$ (ppm) | — | — | 0 |
| Power (W) | 30 | 100 | 10 |
| inner pressure of reactor (Torr) | 0.5 | 1.0 | 1.0 |
| time | 30 | 5 | 40 |

TABLE 39-continued

| | adhesive layer | CTL | CGL |
|---|---|---|---|
| | (minute) | (hour) | (minute) |
| thickness of layer (μm) | 0.17 | 5.5 | 0.5 |
| C content (atomic %) = C / (C + Al) | 98 | 100 | 0 |
| hydrogen content (atomic %) = H / all atoms | 55 | 60 | 20 |
| Al content (atomic %) = Al / (C + Al) | 2 | — | — |
| $V_0$ (V) | | — | |
| $E_{\frac{1}{2}}$ (lux.sec) | | — | |
| separateness(1) | | o | |
| residual potential Vr (V) | | — | |
| repetition stability | | — | |
| adhesivity of the adhesive layer to CTL | | x | |

(1)the same manner as Table 1
*use of $SiH_4$

TABLE 40

| | adhesive layer | CTL | CGL |
|---|---|---|---|
| $C_2H_4$ (sccm) | ** | 60 | 0 |
| $H_2$ (sccm) | | 80 | 210 |
| $SiH_4$ (sccm) | | 0 | 90 |
| $B_2H_6 + H_2$ (sccm) | | 0 | 0 |
| $B_2H_6/SiH_4$ (ppm) | | — | 0 |
| Power (W) | | 100 | 10 |
| inner pressure of reactor (Torr) | | 1.0 | 1.0 |
| time | | 5 (hour) | 40 (minute) |
| thickness of layer (μm) | 0.17 | 5.5 | 0.5 |
| C content (atomic %) = C / (C + Si) | — | 100 | 0 |
| hydrogen content (atomic %) = H / all atoms | 0 | 60 | 20 |
| $V_0$ (V) | | — | |
| $E_{\frac{1}{2}}$ (lux.sec) | | — | |
| separateness(1) | | o | |
| residual potential Vr (V) | | — | |
| repetition stability | | — | |
| adhesivity of the adhesive layer to CTL | | x | |

(1)the same manner as Table 1
**high-vacuum metallizing of Al by electric resistant heating

TABLE 41

| | adhesive layer | CTL | CGL |
|---|---|---|---|
| $C_2H_4$ (sccm) | 100 | none | process (III) of Comp. exam. 1 |
| $H_2$ (sccm) | 100 | | |
| $SiH_4$ (sccm) | 60 | | |
| $B_2H_6 + H_2$ (sccm) | 0 | | |
| $B_2H_6/SiH_4$ (ppm) | 0 | | |
| Power (W) | 15 | | |
| inner pressure of reactor (Torr) | 1.0 | | |
| time | 17 (minute) | | |
| thickness of layer (μm) | 0.17 | | |
| C content (atomic %) = C / (C + Si) | 50 | | |
| hydrogen content (atomic %) = H / all atoms | 44 | | |
| Si content (atomic %) = Si / (C + Si) | 50 | | 50 |
| $V_0$ (V) | | −80 | |
| $E_{\frac{1}{2}}$ (lux.sec) | | 7.7 | |
| separateness(1) | | no separation (o) | |
| residual potential Vr (V) | | x | |
| repetition stability | | x | |
| adhesivity of the adhesive layer to CTL | | o | |

(1)the same manner as Table 1

TABLE 42

| | adhesive layer | CTL | CGL |
|---|---|---|---|
| $C_2H_4$ (sccm) | 100 | process (II) of Comp. exam. 2 | process (III) of Comp. exam. 2 |
| $H_2$ (sccm) | 100 | | |
| $SiH_4$ (sccm) | 60 | | |
| $B_2H_6 + H_2$ (sccm) | 60 | | |
| $B_2H_6/SiH_4$ (ppm) | 0 | | |
| Power (W) | 15 | | |
| inner pressure of reactor (Torr) | 1.0 | | |
| time | 17 (minute) | | |
| thickness of layer (μm) | 0.17 | | |
| C content (atomic %) = C / (C + Si) | 50 | | |
| hydrogen content (atomic %) = H / all atoms | 44 | | |
| Si content (atomic %) = Si / (C + Si) | 50 | | |
| $V_0$ (V) | | −620 | |
| $E_{\frac{1}{2}}$ (lux.sec) | | not reached to half value of exposed dose | |
| separateness(1) | | no separation (o) | |
| residual potential Vr (V) | | x | |
| repetition stability | | x | |
| adhesivity of the adhesive layer to CTL | | o | |

(1)the same manner as Table 1

TABLE 43

| | adhesive layer | CTL | CGL |
|---|---|---|---|
| $C_2H_4$ (sccm) | 100 | process (II) of Comp. exam. 3 | process (III) of Comp. exam. 3 |
| $H_2$ (sccm) | 100 | | |
| $SiH_4$ (sccm) | 60 | | |
| $B_2H_6 + H_2$ (sccm) | 0 | | |
| $B_2H_6/SiH_4$ (ppm) | 0 | | |
| Power (W) | 15 | | |
| inner pressure of reactor (Torr) | 1.0 | | |
| time | 17 (minute) | | |
| thickness of layer (μm) | 0.17 | | |
| C content (atomic %) = C / (C + Si) | 50 | | |
| hydrogen content (atomic %) = H / all atoms | 44 | | |
| Si content (atomic %) = Si / (C + Si) | 50 | | 50 |
| $V_0$ (V) | | could not be gained because of low resistance | |
| $E_{\frac{1}{2}}$ (lux.sec) | | | |
| separateness(1) | | no separation (o) | |
| residual potential Vr | | bad to | |

TABLE 43-continued

| | adhesive layer | CTL | CGL |
|---|---|---|---|
| (V) | | adhesivility to CTL | |
| repetition stability adhesivity of the adhesive layer to CTL | | x | |

(1)the same manner as Table 1

What is claimed is:

1. A photosensitive member comprising:

an electrically conductive substrate;

an adhesive layer on said substrate comprising amorphous carbon containing hydrogen, said adhesive layer comprising at least one element selected from silicon, germanium and aluminum, and having a thickness of about 0.01 μm to 0.5 μm;

a charge transporting layer comprising amorphous carbon containing hydrogen, said hydrogen being contained in an amount of about 0.1 to 67 atomic percent based on the amount of all atoms contained in said charge transporting layer and said charge transporting layer having a relative dielectric constant of about 2.0 to 6.0; and a charge generating layer.

2. A photosensitive member of claim 1, in which said element is uniformly contained in said adhesive layer.

3. A photosensitive member of claim 2, in which the amount of said element represented by the formula of M/(C+M) (in which C is the amount of the carbon and M is the amount of the element) is about 5 to 95 atomic %.

4. A photosensitive member of claim 1, in which said element is distributed irregularly in the direction of the layer thickness direction.

5. A photosensitive member of claim 1, in which hydrogen contained in said adhesive layer is in an amount of about 0.1 to 67 atomic % based on the amount of all atoms contained in said adhesive layer.

6. A photosensitive member of claim 1, in which said hydrogen is preferably contained in the charge transporting layer in an amount of 30 to 60 atomic % based on the amount of all atoms contained in said charge transporting layer.

7. A photosensitive member comprising:

an electrically conductive substrate;

an adhesive layer on said substrate comprising amorphous carbon containing hydrogen, said adhesive layer comprising at least one element selected from silicon, germanium and aluminum, and having a thickness of about 0.01 μm to 0.5 μm;

a charge transporting layer comprising amorphous carbon containing hydrogen, said hydrogen being in an amount of about 0.1 to 67 atomic percent based on the amount of all atoms contained in said charge transporting layer; and a charge generating layer.

* * * * *